US008807111B2

(12) United States Patent
Hughes

(10) Patent No.: US 8,807,111 B2
(45) Date of Patent: Aug. 19, 2014

(54) OIL PUMP MODIFICATION SYSTEM

(71) Applicant: Frank A. Hughes, Shelton, WA (US)

(72) Inventor: Frank A. Hughes, Shelton, WA (US)

( * ) Notice: Subject to any disclaimer, the term of this patent is extended or adjusted under 35 U.S.C. 154(b) by 38 days.

(21) Appl. No.: 13/815,615

(22) Filed: Mar. 13, 2013

(65) Prior Publication Data

US 2013/0263827 A1 Oct. 10, 2013

Related U.S. Application Data

(60) Provisional application No. 61/621,744, filed on Apr. 9, 2012.

(51) Int. Cl.

| | |
|---|---|
| ***F01M 11/03*** | (2006.01) |
| ***F02M 39/00*** | (2006.01) |
| ***F01M 1/10*** | (2006.01) |
| *F01M 1/02* | (2006.01) |

(52) U.S. Cl.

CPC ..... *F02M 39/00* (2013.01); *F01M 2001/0253* (2013.01); *F01M 2011/031* (2013.01); *F01M 2011/035* (2013.01); *F01M 1/10* (2013.01)

USPC ..... 123/196 R; 123/196 A; 123/198 C

(58) Field of Classification Search

USPC ..... 123/196 R, 196 A, 196 S, 196 C, 196 CP, 123/198 R, 198 C, 198 P, 198 DA; 184/1.5, 184/6.24, 6.28

See application file for complete search history.

(56) References Cited

U.S. PATENT DOCUMENTS

| | | | | | |
|---|---|---|---|---|---|
| 3,384,063 | A | * | 5/1968 | Moulton et al. | 123/198 C |
| 3,777,847 | A | * | 12/1973 | Lawless | 184/109 |
| 4,406,784 | A | * | 9/1983 | Cochran | 210/167.05 |
| 4,452,695 | A | * | 6/1984 | Schmidt | 210/167.05 |
| 4,561,395 | A | * | 12/1985 | McMullen | 123/196 A |
| 4,752,387 | A | * | 6/1988 | Thomas | 210/167.05 |
| 4,834,040 | A | * | 5/1989 | Yoshida | 123/198 C |
| 5,298,158 | A | * | 3/1994 | Anderson | 210/167.04 |
| 5,511,522 | A | * | 4/1996 | Tran | 123/196 S |
| 5,558,058 | A | * | 9/1996 | Ming et al. | 123/196 A |
| 5,771,854 | A | | 6/1998 | Barton | |
| 6,126,818 | A | * | 10/2000 | Duerrstein et al. | 210/132 |
| 6,267,094 | B1 | * | 7/2001 | Kuettner et al. | 123/196 A |
| 6,951,606 | B2 | * | 10/2005 | Cousineau et al. | 210/104 |
| 7,300,581 | B2 | * | 11/2007 | Seipold | 210/232 |
| 7,739,997 | B2 | * | 6/2010 | Leisner | 123/196 R |
| RE42,408 | E | * | 5/2011 | Havlik et al. | 417/310 |
| 8,181,745 | B1 | * | 5/2012 | Stanfield et al. | 184/1.5 |

* cited by examiner

*Primary Examiner* — Thomas Moulis
(74) *Attorney, Agent, or Firm* — Brian J. Coyne

(57) ABSTRACT

An oil pump modification adaptor for retrofitting an automobile engine that converts a no-filtration system or a bypass filtration system to a full-flow filtration system. The adaptor modifies the oil pump by providing a full-flow filtration that removes suspended particulates in the oil, so that the particulates do not damage the engine. The flow path of a lubricating oil is modified such that oil is prevented from directly entering the engine unfiltered from an oil reservoir. The adaptor has an integral oil pressure regulator that maintains design oil pressure during conditions of low and high engine speed while directing oil through a filter before entering the engine galleries and passages. The adaptor easily installs and replaces an end plate on a pump housing on the original pump.

18 Claims, 17 Drawing Sheets

OIL PUMP MODIFICATION SYSTEM

CROSS REFERENCE TO RELATED APPLICATIONS

This application claims the benefit of a provisional application by the same applicant for the same invention filed in the United States Patent and Trademark Office on Apr. 9, 2012, application No. 61/621,744.

STATEMENT REGARDING FEDERALLY APPROVED RESEARCH OR DEVELOPMENT

None.

TECHNICAL FIELD

The present disclosure relates generally to an oil pump modification adaptor for a reciprocating, internal combustion engine. More particularly, the present invention relates to an oil pump modification adaptor for a reciprocating, internal combustion engine that converts a no-filtration system or bypass filtration system a full-flow oil filtration system.

BACKGROUND OF THE INVENTION

All engines have many moving parts that require lubrication to minimize friction when the engine operates. The lubrication allows the engine to work more efficiently and with reduced wear and tear. Lubricants not only lubricate the moving parts, but also cool the engine, inhibit corrosion, collect dirt, metal debris, soot and other particulates that damage the engine.

Very early motor vehicle engines did not have oil filters, allowing the engine oil to quickly become contaminated. The oil had to be changed frequently. After World War I, a bypass filter system was developed for the automotive engine. An oil pump forced a gross unregulated output into a plurality of distribution passages within the engine and controlled oil pressure downstream through a regulator. All of the oil was pumped directly from the oil reservoir by an oil pump to the moving parts without filtration, and in the bypass filtration, a smaller proportion of the oil was sent through the bypass filter and returned directly to the reservoir. Particulates not caught by the filter continued to circulate with the oil. The relatively basic lubricating oil was primarily hydrocarbons from petroleum, and had to be changed frequently to remove accumulated contaminants.

Development of performance-enhancing additives for lubricating oil began in earnest during World War II. Their specially designed properties allow a wider temperature range with measurably better viscosity performance at service temperature extremes. Additionally, contemporary lubricating oils have better chemical stability, being resistant to oxidation and thermal breakdown and better shear stability when compared to the traditional oils. Contemporary oils on the market also have additive compounds such as detergents and surfactants that suspend particulate so that they are delivered to a filter in the oil distribution system. Most particulates do not settle out in the reservoir; instead, they continue to circulate as oil contaminants until captured within an oil filter.

Since these contemporary oils last longer in terms of physical and chemical stability, the need to change the oil is less frequent. With less frequent oil changes, the particulates accumulate, offsetting certain advantages of the contemporary oils. If the oil is recirculated without complete filtering, as in the bypass filter system or when there is no oil filter system, the suspended particulates accelerate engine wear and tear.

To avoid the detrimental effects of unfiltered, contemporary oils on very early motor vehicle engines, better filtering of the oil is required so that particulate build-up is minimized. Newer automobiles employ a full-flow system, wherein all of the oil passes through the oil filter system in a single flow path, the oil moving from the oil reservoir to the engine by first moving through the filter. Older motor vehicles with the bypass system or without a filter system cannot take full advantage of the higher performing contemporary oils. Although the old-fashioned lubricants are still on the market, car enthusiasts who operate older automobiles having the bypass system or no filter system desire to use contemporary engine oils. However, without a full-flow filter system, they are limited to the use of old-fashioned products or with misuse of contemporary oils.

Some have seen the advantage of a full-flow system for older automobiles and have developed a way to retrofit air-cooled engines with a full-flow system. While these retrofit units may be suitable for the particular purpose employed, or for general use, they would not be suitable for the purposes of the present disclosure as disclosed hereafter. None, however, have converted a no-filter system or a bypass system into a full-flow system for retrofitting the older motor vehicle engine and thereby permit safe use of contemporary oils.

In the present disclosure, where a document, act or item of knowledge is referred to or discussed, this reference is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

SUMMARY OF THE INVENTION

An object of an example embodiment in the present disclosure is to provide an adaptor that modifies a lubricating oil flow path within an engine to remove suspended particulates from lubricating oil. Accordingly, the example embodiment is an adaptor that changes the flow path of a lubricating oil within an engine, the engine having no filter or a bypass filter, changing the oil flow path to a full flow through a filter.

A further object of an example embodiment in the present disclosure is to provide an adaptor that allows all lubricating oil needed to lubricate a plurality of moving parts in an engine to pass through a filter before entering a plurality of oil galleries and passages in the engine. Accordingly, the example embodiment is an adaptor that changes the flow path of a lubricating oil so that a net oil flow required by lubricating the moving parts passes through a filter, preventing oil from a reservoir directly entering the engine galleries and passages.

Another object of an example embodiment in the present disclosure is to provide an adaptor that modifies an oil pump in an engine having no filter or a bypass filter so that, when the engine is lubricated by a contemporary lubricating oil that suspends the particulates, the particulates do not damage the engine. Accordingly, the example embodiment in the present disclosure provides an adaptor that modifies an oil pump in an engine having no filter or a bypass filter, passing the contemporary lubricating oil through a filter so that, when the engine uses a contemporary lubricating oil that suspends the particulates, the particulates are removed by full flow filtration and do not damage the engine.

Yet another object of an example embodiment in the present disclosure is to provide an adaptor that modifies an oil pump in an engine having no filter or a bypass filter to a full flow filter while maintaining design oil pressure in the engine during operation. Accordingly, the example embodiment in the present disclosure provides an adaptor having an integral pressure regulator that maintains design oil pressure during conditions of low and high engine speed.

A further object of to provide an adaptor/pump combination in which such an adaptor is joined not only to an oil pump but also to an oil filter assembly to provide full-flow oil filtration for an internal combustion engine.

A still further object is to incorporate just the regulator components of the adaptor into the housing of an oil pump having an attached oil filtration assembly to form an integral, oil pump/oil filtration assembly combination to provide full flow oil filtration for an internal combustion engine.

The present disclosure is an oil pump modification adaptor for retrofitting a motor vehicle engine that converts a no filtration system or a bypass filtration system to a full flow filtration system. The adaptor modifies the oil pump so that the engine can safely use a lubricating oil, even a contemporary lubricating oil, by providing full flow lubrication that removes a plurality of suspended particulates in the oil, so that the particulates do not damage the engine. The flow path of lubricating oil is modified such that oil is prevented from directly entering the engine unfiltered from an oil reservoir. The adaptor has an integral oil pressure regulator that maintains design oil pressure during normal operating conditions while directing oil to pass through the filter before entering the engine galleries and passages. The adaptor easily installs and replaces an end plate on an oil pump housing on the original pump.

The present disclosure addresses at least one of the disadvantages discussed hereinabove. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are denoted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF PREFERRED EMBODIMENTS OF THE INVENTION

Figure 1:
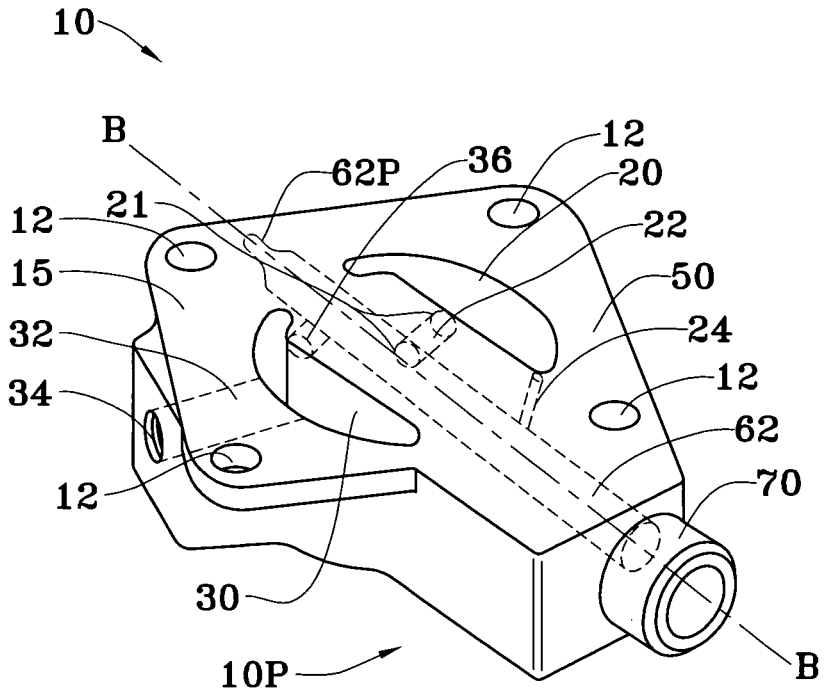
FIG. 1 is a diagrammatic perspective view of a housing for an oil pump modification adaptor, showing an interior mating surface of the adaptor and a plurality of internal channels shown in outline.
Figure 2:
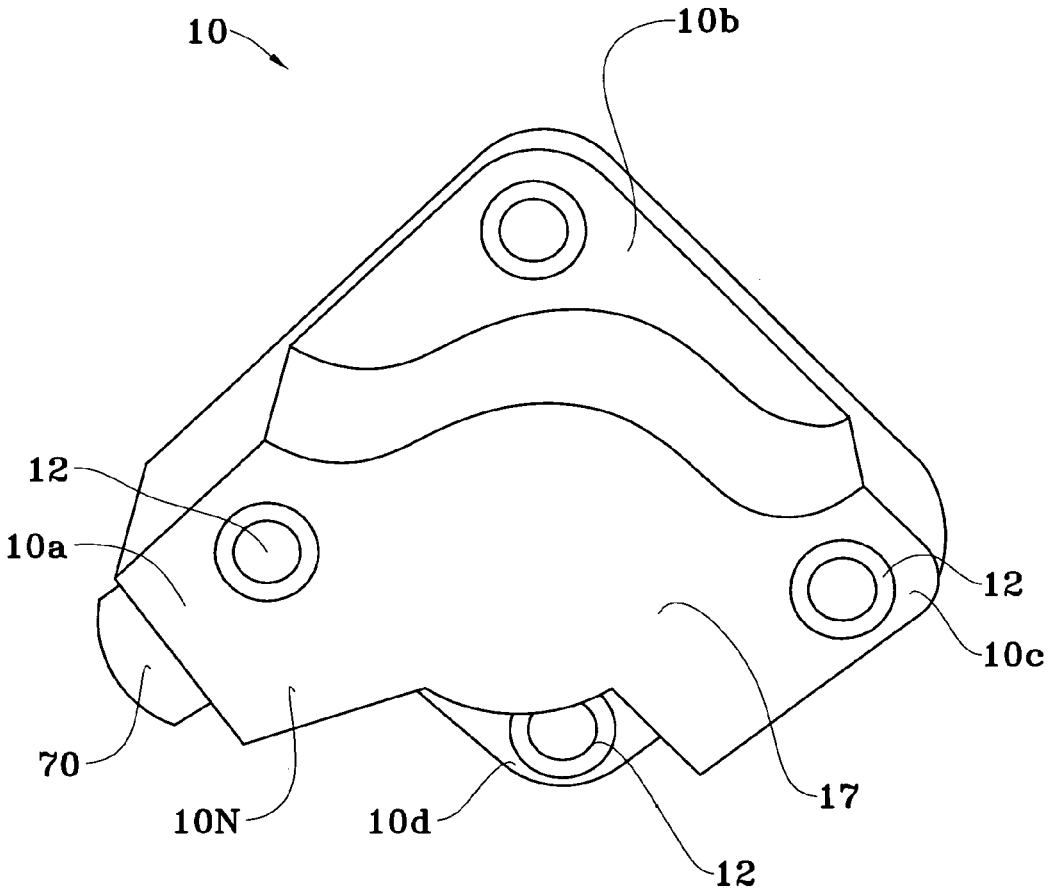
FIG. 2 is a diagrammatic perspective view of the housing for the pump modification adaptor, showing a closed, exterior side of the adaptor.

FIG. 1 illustrates an oil pump modification adaptor 10 for a reciprocating, internal combustion, automobile engine that converts a no-filter system or a bypass filter engine lubrication system to a full-flow filter system. The adaptor 10 attaches to an oil pump 108 of such an engine. The engine includes an engine block 100 having an oil reservoir 102. The engine block has an oil outlet port 122 in communication with the oil reservoir 102 and an oil inlet port 124 in communication with oil galleries and passages of the engine block. The engine further includes oil pump drive means 108D for powering the oil pump 108 during engine operation.

Figure 4:
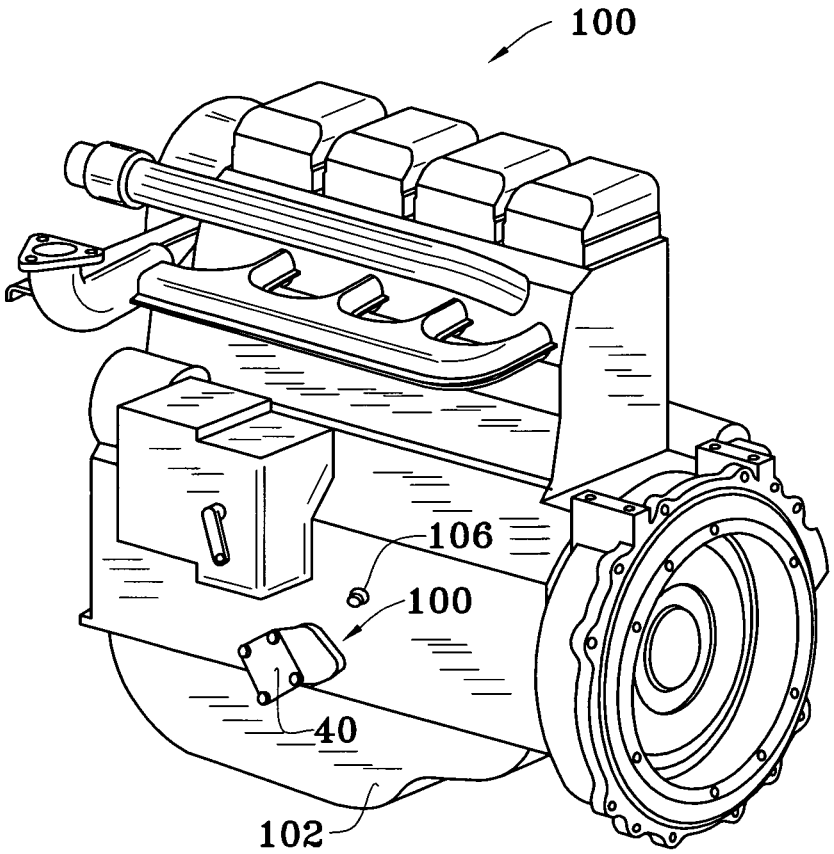
FIG. 4 (PRIOR ART)
FIG. 4 is a perspective view of a pump on an engine prior to installation of the adaptor.
Figure 6:
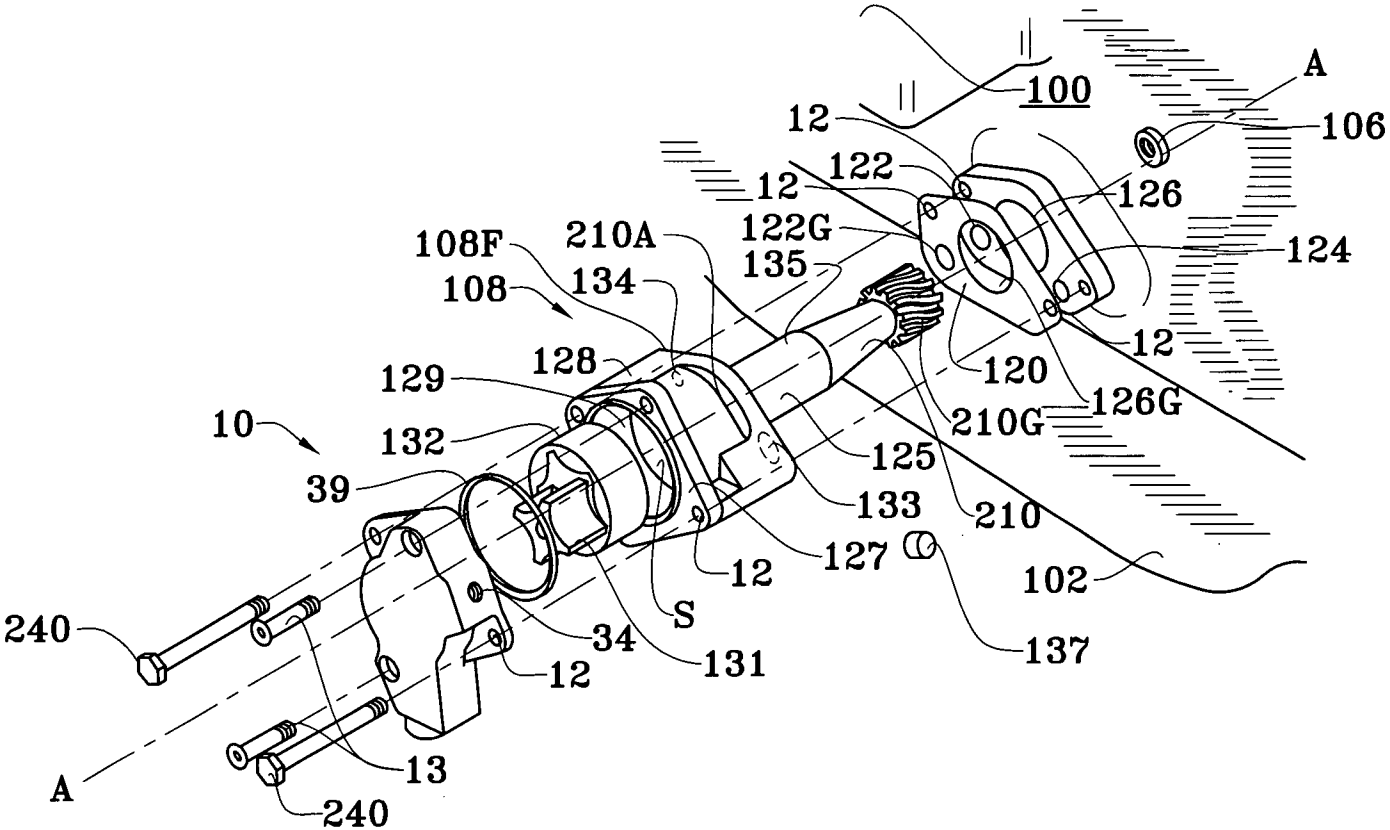
FIG. 6 is an exploded view of the pump modification adaptor connecting to an oil pump.
Figure 9:
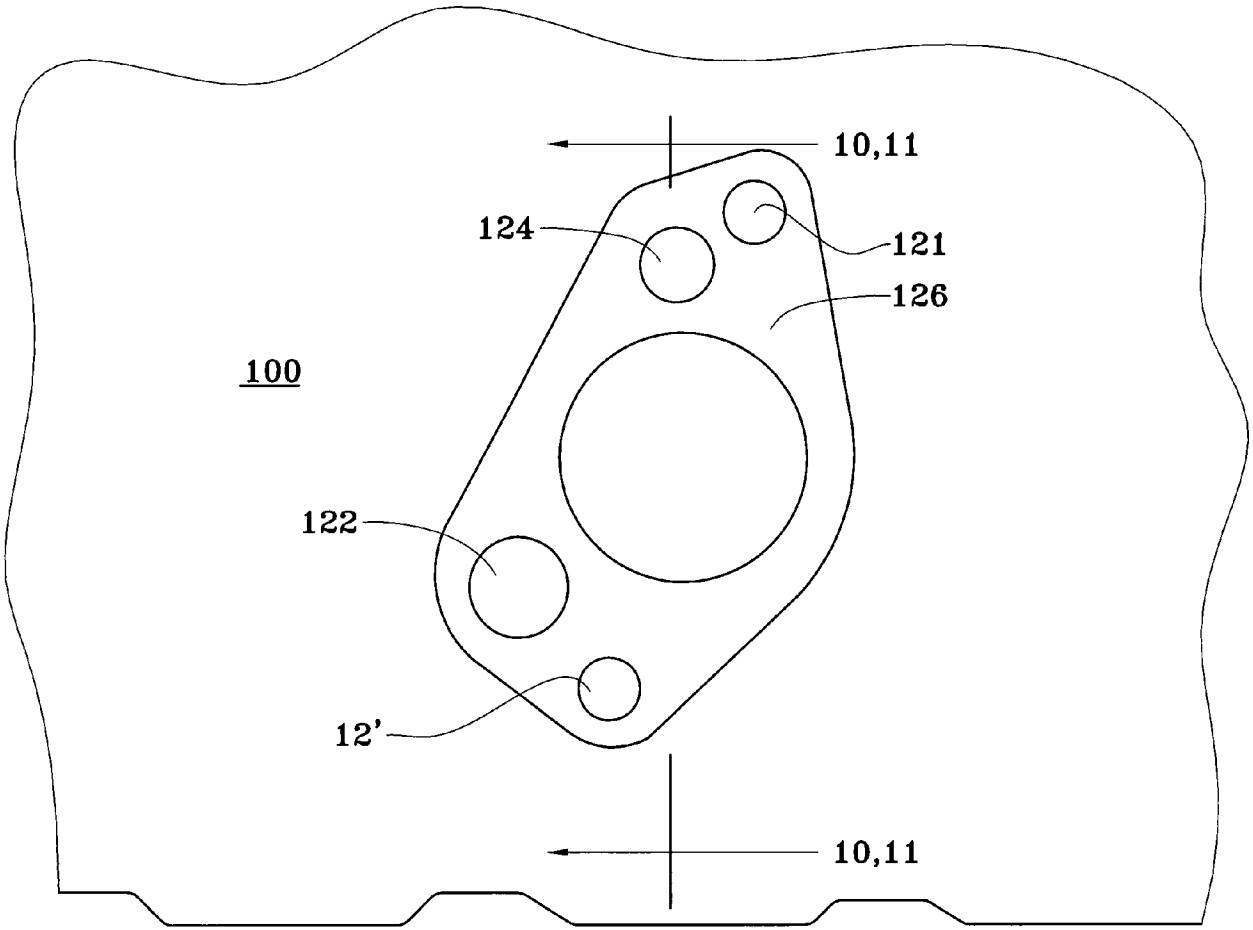
FIG. 9 is a side elevational view of the oil-mount portion of a Hudson automobile engine block from which the oil pump has been removed, depicting the engine oil inlet and outlet ports.

Referring to FIG. 6, the oil pump 108 has a pump housing 128 that extends along an axis A-A from an interior wall 125 to an opposite, flat, exterior wall 127 thereof and defines a hollow, cylindrical, interior space S between said walls. The interior wall 125 of the pump 108 mounts to an exterior surface of the engine block 100 where the engine oil inlet port 124 and oil outlet port 122 are located; FIG. 9. Prior to installation of the adaptor 10 on the oil pump 108, the exterior side 27 of the oil pump is covered by an original equipment, steel end plate 40; FIG. 4. Installation of the adaptor 10 requires removal of the steel end plate 40 from the oil pump 108 and substitution therefor of the adaptor with an O-ring 39 interposed between the adaptor and the exterior wall 127.

The exterior wall 127 of the pump housing 128 has a circular opening 129 in communication with the hollow, cylindrical, interior space S of the housing 128. A pump oil inlet port 134 extends from a first, interior surface of, and part way through, the interior wall 125 of the pump 108 and communicates with an oil inlet cavity 220 cut out of an opposite, second surface of said interior wall. A pump oil outlet port 34 extends from said first, interior surface of, and part way through, the interior wall 125 of the pump and communicates with a pump oil outlet cavity 230 cut out of said opposite, second surface of said interior wall. Accordingly, the inlet cavity 220 and the outlet cavity, 230, disposed in side by side relation, communicate with the interior space S of the housing.

Figure 12:
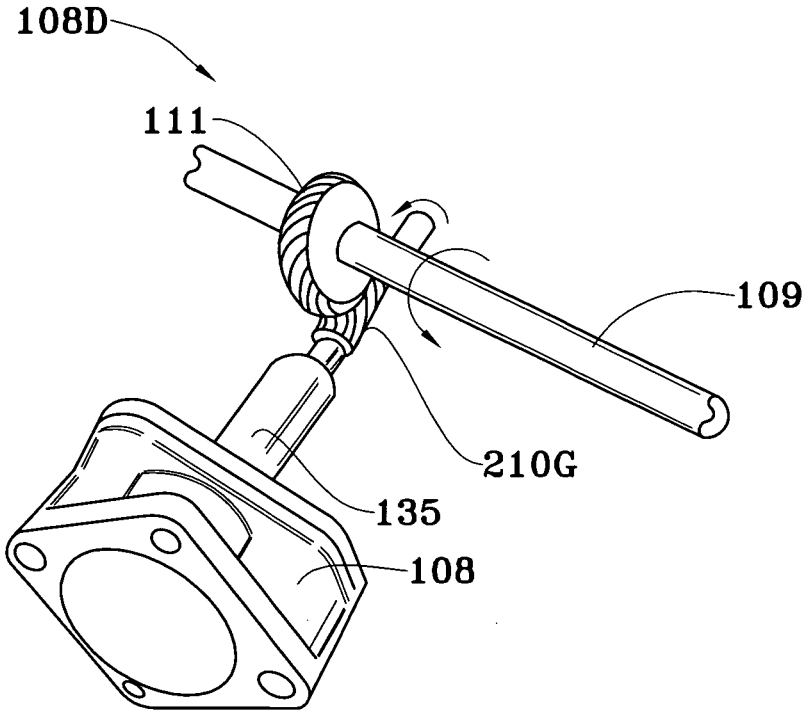
FIG. 12 (PRIOR ART)
FIG. 12 is a schematic diagram of a Hudson automobile oil pump in driven engagement with oil pump drive means.

A rotor shaft 210 is mounted for rotation about the shaft axis A-A within the interior space S of the housing 128. The shaft 210 extends along the shaft axis A-A from an exterior end thereof within the housing 128, through the housing, protrudes through a shaft aperture 128A in the interior wall 125, and extends through an elongated, ferrule extension 135 of the interior wall to an interior end thereof. The interior end of the shaft 210 terminates in means 210G for coupling the rotor shaft 210 to the oil pump drive means 108 D in rotary, driven engagement, which coupling means, in the case of the example Hudson automobile engine, is a helical spur gear in driven engagement with a mating gear 111 mounted on the engine camshaft 109; FIGS. 6 and 12. A rotor element assembly R is in rotary, driven engagement with the exterior end of the rotor shaft 210 for pumping oil from within the interior space S of the housing 120 out the pump outlet port 133. The original equipment Hudson automobile pump 108 being a trochoid pump, the rotor element assembly R comprises an inner trochoid element fixed to the exterior end of the shaft 210 and a surrounding, trochoid ring element 132.

Figure 8:
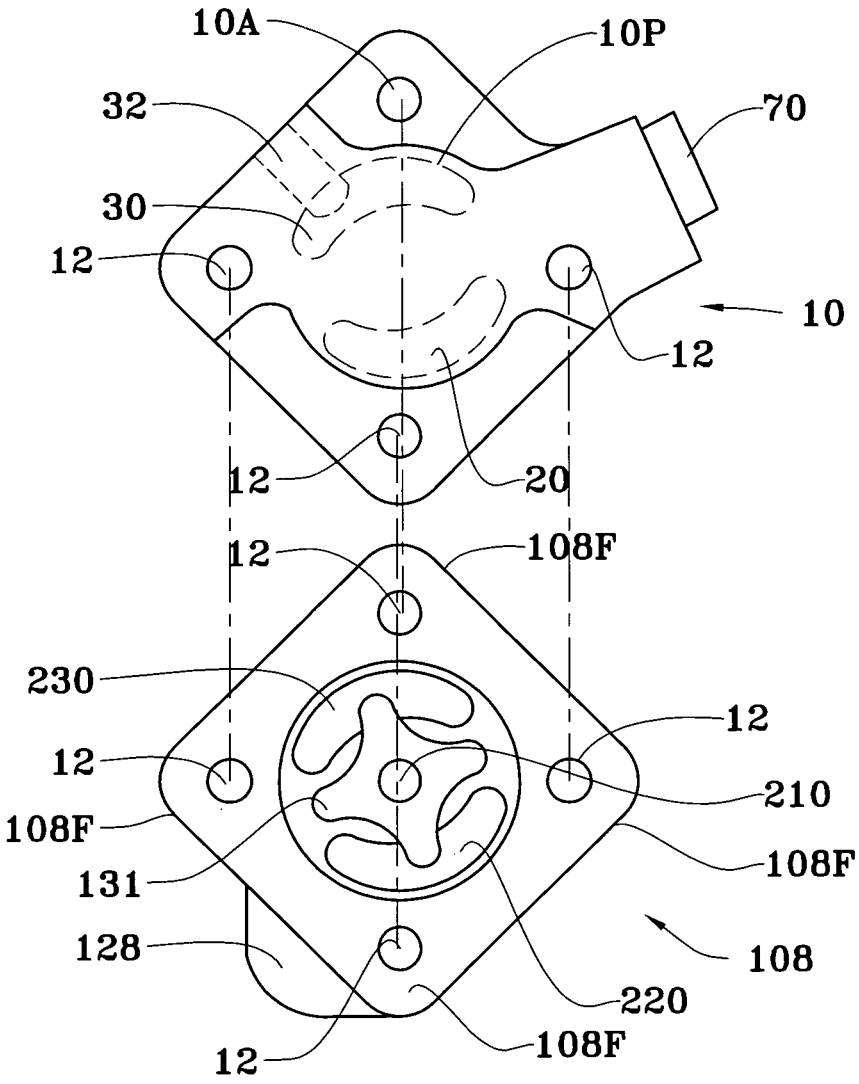
FIG. 8 is a perspective view of an original equipment oil pump from a Hudson automobile with its steel end plate removed and shown matingly aligned with the pump modification adaptor, wherein the distribution cavity, the circulation cavity and the outlet port channel of the adaptor are depicted in phantom outline.

As best seen in FIG. 8, the exterior wall 127 of the pump 108 includes four corner flanges 108F: a first pair of corner flanges 108F, oppositely disposed to each other, each with a relatively large fastener opening 12, and a second pair of corner flanges, oppositely disposed to each other, each with a relatively small, threaded, fastener opening 12. A substantially rectangular, steel end plate 40 having a mounting aperture 12 at each of its four corners is removably attached to the exterior wall 127 of the pump 108 by a first pair of threaded fasteners 240 inserted through said mounting apertures and through the fastener openings 12 of the first pair of corner flanges 127F, which fasteners are threaded into mating, threaded openings 12' in the block 100, which first pair of fasteners also secure the pump to the block. The end plate 40 is also attached to the exterior wall 127 by a second pair of threaded fasteners 13 inserted through corner apertures 12 of the end plate and through the fastener openings 12; see FIGS. 4, 8 and 9.

Figure 10:
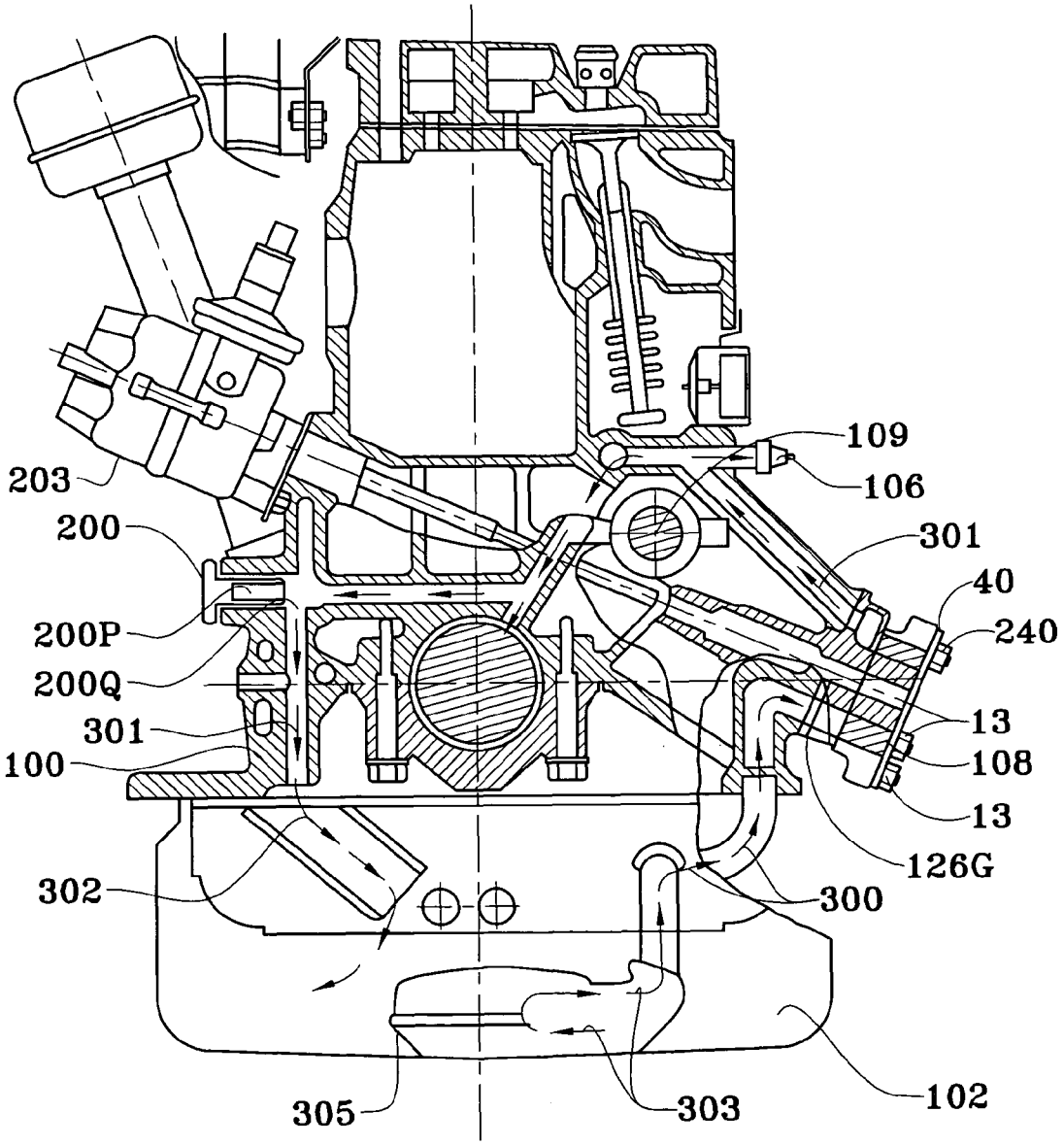
FIG. 10 (PRIOR ART)
FIG. 10 is a lateral, cross-sectional view thereof along line 10-10 of FIG. 9 showing the original flow path of lubricating oil prior to modification thereof by installation of the adaptor.

Referring now to FIGS. 8, 9 and 10, it is seen that in the original oil path configuration and prior to modification thereof by installation of the adaptor 10, lubricating oil is drawn from the oil reservoir 102 (arrows 300) during engine operation through the engine outlet port 122, thence through the matingly aligned pump oil inlet port 134 into the inlet cavity 220 of the pump 108. From the pump inlet cavity 220 the oil enters the hollow, cylindrical, interior space S within the pump housing 128 and is pumped by the rotation of the rotor assembly R out the pump outlet port 133 and directly into the matingly aligned block inlet port 124. The oil proceeds (arrows 301) from the block inlet port 124 through the engine oil passages and galleries to an oil pressure regulating valve 200 mounted in the block below the distributor 203. The valve 200 has a spring-loaded plunger 200P slidably mounted within a bore. The valve 200 is normally closed—that is, at engine startup and so long as the oil pressure is below engine design oil pressure, the spring maintains the plunger 200P in a position within the valve bore that occludes an oil exit orifice 200 Q of the valve. When the flow volume of oil within the engine block is sufficient to bring the engine lubrication system up to design oil pressure, the spring compresses and the plunger 200P is displaced from the normally-closed position of the valve, which variably uncovers the oil exit orifice 200Q and permits the surplus volume of oil to flow through the oil exit orifice and back to the oil reservoir 102 (arrows 302) where it passes (arrows 303) through a screen 305 before being drawn back up into the pump 108.

Figure 13:
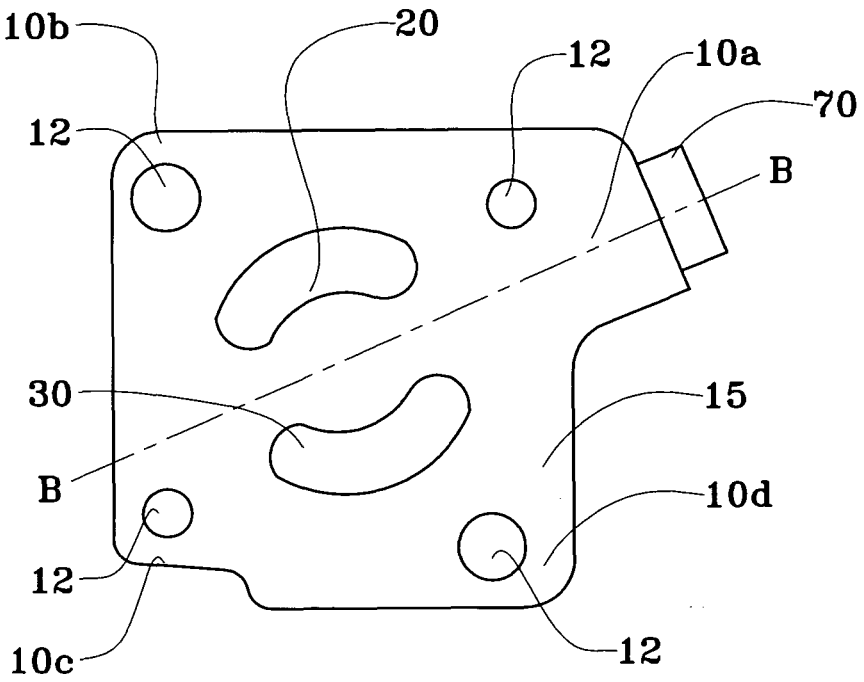
FIG. 13 is an enlarged, elevational view of an interior side of the adaptor prior to attachment to the oil pump.
Figure 14:
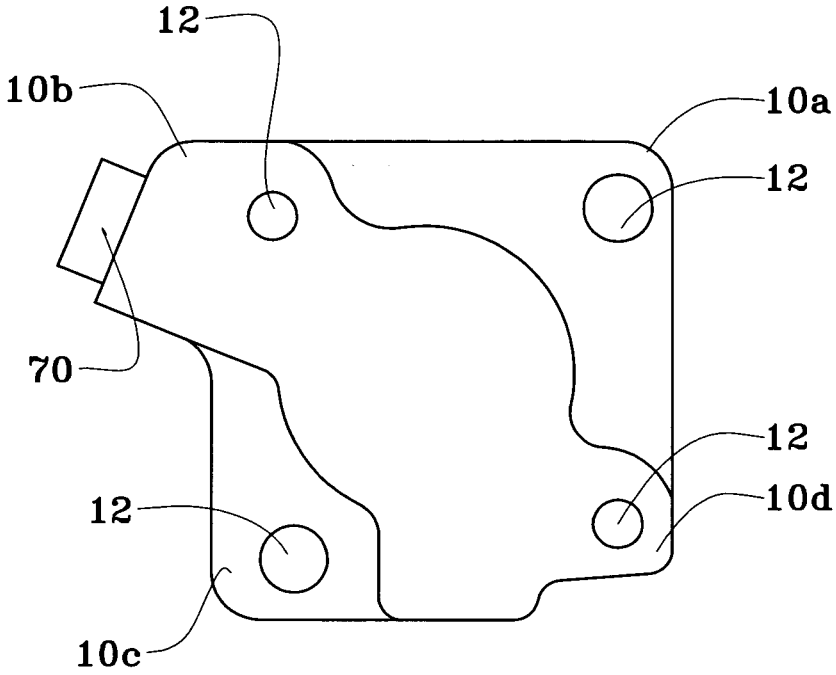
FIG. 14 is an enlarged, elevational view of an exterior side thereof.

As may be seen in FIGS. 1-3, 6, 8, 11, 13, and 14, the adaptor 10 comprises a solid, rigid, plate 10P, preferably cast metal, with a flat, interior side 15 and an opposite, exterior side 17. In the illustrated example for the Hudson automobile engine, the plate 10P has a neck portion 10N contiguous with a generally rectilinear portion in both exterior side and interior side plan view, which rectilinear portion has first 10*a*, second 10*b*, third 10*c* and fourth 10*b* corner portions; FIGS. 13, 14. But, the exterior shape need not be as illustrated. It is enough that the plate 10P is shaped and dimensioned such that, when the exterior wall 127 of the pump 108 has been exposed by removal therefrom of the end plate 40, and the adaptor 10 has been attached to said exterior wall 127 with the fasteners 13, the adaptor completely covers the exterior wall 127 of the pump.

An oil distribution cavity 30 and an oil circulation cavity 20 extend part way through the adaptor 10 from the interior side 15 toward the exterior side 17 thereof and are disposed in spaced apart, side by side relation such that, when the interior side of the adaptor is attached to the exterior wall 127 of the pump, the oil distribution 30 and circulation 20 cavities matingly align and are in fluid communication with the oil outlet 230 and inlet 220 cavities of the pump, respectively; see FIG. 8. Because the original equipment Hudson pump oil outlet cavity 230 and the pump oil inlet cavity 220 are each crescent-shaped in lateral cross-section (FIG. 8), the mating oil distribution cavity 30 and the oil circulation cavity 20 of the adaptor 10, respectively, are also crescent-shaped in lateral cross-section; FIG. 13. Unlike a bypass filter system or a no-filter system, wherein the oil flows through the pump 108 directly back to the engine block 100, the distribution cavity 30 of the present adaptor 10 directs oil, depending on whether the volume of the oil produced by the pump is at or below that which is sufficient to achieve design oil pressure, either entirely through an outlet port 34 that connects to an oil filter 110 (i.e., low oil flow volume conditions) or through an outlet port 34 of the adaptor that connects to an oil filter 110 and variably back into the circulation cavity 20 for recirculation within the pump (i.e., high oil flow volume conditions). Accordingly, installation of the adaptor on the pump 108 includes occluding the pump outlet port 133 with an occluding means 137 (FIG. 6) to prevent oil from being pumped during engine operation out of that port.

To maintain oil pressure at or near a design oil pressure for the engine, the adaptor has an integral oil pressure regulator. The regulator, shown in FIG. 3 and as described hereinbelow, is situated inside a hollow, regulator bore 62 aligned along a bore axis B-B, depicted in FIGS. 1 and 3. The regulator bore 62 extends from an open end 62R thereof in a neck portion 10N of the plate 10P to an opposite, blind, plunger end 62P located in the third corner portion 10*c* of the adaptor 10. The plunger end 62P of the regulator bore 62 is in fluid communication with the distribution cavity 30 via a regulator bore inlet passage 36 that extends from the distribution cavity to the plunger end. An outlet channel 22 is disposed intermediate the regulator bore inlet passage 36 and the open end 62R of the regulator bore 62 and extends from a regulator bore outlet port 21 in the regulator bore 62 to the circulation cavity 20. A pressure relief channel 24 is disposed intermediate the outlet channel 22 and the open end 62R of the regulator bore 62 and extends from the regulator bore 62 to the circulation cavity 20. A regulator plunger 68 is disposed for sliding, reciprocating movement within the plunger bore 62. A hollow, cylindrical spring guide is inserted through the open end of the regulator bore 62 and extends part way through the bore 62 toward the regulator plunger 68. The spring guide 66 has a closed, external end 66C covered by a spring retainer cap 70 fixed to the open end of the regulator bore 62 and an opposite, open, circular, internal end 66E. A compression spring 64 is interposed and compressed between the spring guide 66 and the regulator plunger 68, a first end portion 64E of the spring being partially recessed within the spring guide and an opposite, end portion 64C of the spring being partially recessed within the regulator plunger 68. The spring 64 has dimensions and spring constant or spring resistance such that, after the occluding means 137 has been attached to outlet port of the pump 108, the end plate 34 has been removed from the pump, and the adaptor has been attached to the exterior wall 127 of the housing 128, with the oil distribution cavity 30 and the circulation 20 cavity of the adaptor matingly aligned and in communication with the oil outlet cavity 230 and the oil inlet cavity 220 of the pump, respectively, and with the engine operating, whenever the pressure of oil on the regulator plunger 68 is less than the engine design oil pressure, the plunger 68 remains at the plunger end 62P of the bore 62 and oil exits the pump through the outlet port 34 of the adaptor and is routed through the oil filter 110 to the engine block 100. When, however, the pressure of oil on the regulator plunger 68 reaches the engine design oil pressure, the oil pressure at the plunger end 62P of the bore forces the regulator plunger 68 to slide against the spring guide 66, compressing the spring 64 and partially or fully uncovering the regulator bore outlet channel 22, whereby oil flows through the regulator bore inlet passage 36 into the regulator bore end 62P, out the regulator bore outlet channel 22 and into the circulation cavity 20, and from there recirculates through the pump 108. See FIG. 11. Thus, axial movement of the plunger 68 against the spring 64 in reaction to rising oil pressure in the regulator bore 62 variably facilitates fluid communication of the distribution cavity 30 with the circulation cavity 20, depending upon whether the oil pressure is below or at the engine design oil pressure. The cross-sectional area of the uncovered portion of the regulator outlet channel 22 is varied with movement of the plunger 68 in proportion with the volume of surplus oil flow, thereby maintaining a constant pressure in the distribution cavity 30 and in oil passages and galleries downstream from the distribution cavity. The remaining volume of oil within the adaptor 10 is directed back into the circulation cavity 20.

At all times the regulator plunger 68 is acted upon by oil pressure as it exists in the regulator bore inlet passage 36. As the plunger 68 is necessarily a free fit in the regulator bore 62, an incidental flow of oil will pass from the regulator bore end 62P past the plunger 68 and into the regulator bore retainer end 62R. Oil thus communicated from the plunger end 62P to the retainer end 62R is returned to the circulation cavity 20 through the relief channel 24. Prevention of oil pressure elevation in the regulator bore end 62R in this manner is crucial to proper operation of the regulator. For the adaptor 10 to operate in the intended manner, it is necessary to deactivate the oil pressure regulating valve 200 in the engine block 100. The valve 200 can be deactivated, for instance, by fixing its plunger 200P permanently in a position that completely occludes the oil exit orifice 200Q of the valve (e.g., with a pin) or by replacing its spring with a less compressible spring that will withstand oil pressures significantly higher than engine design oil pressure before compressing enough for the plunger to be displaced sufficiently to uncover the oil exit orifice of the valve, in which latter case the oil regulating valve 200 serves as a safety relief valve.

It will be understood that the adaptor 10 can be used with both pre-contemporaneous lubricating oils as well as with a contemporary oils having additives that suspend the particulates rather than having the particulates settle into the oil reservoir 102. If the contemporary oil is not filtered before it is introduced to the moving parts of the engine, the particulates cause excessive wear and tear.

Figure 5:
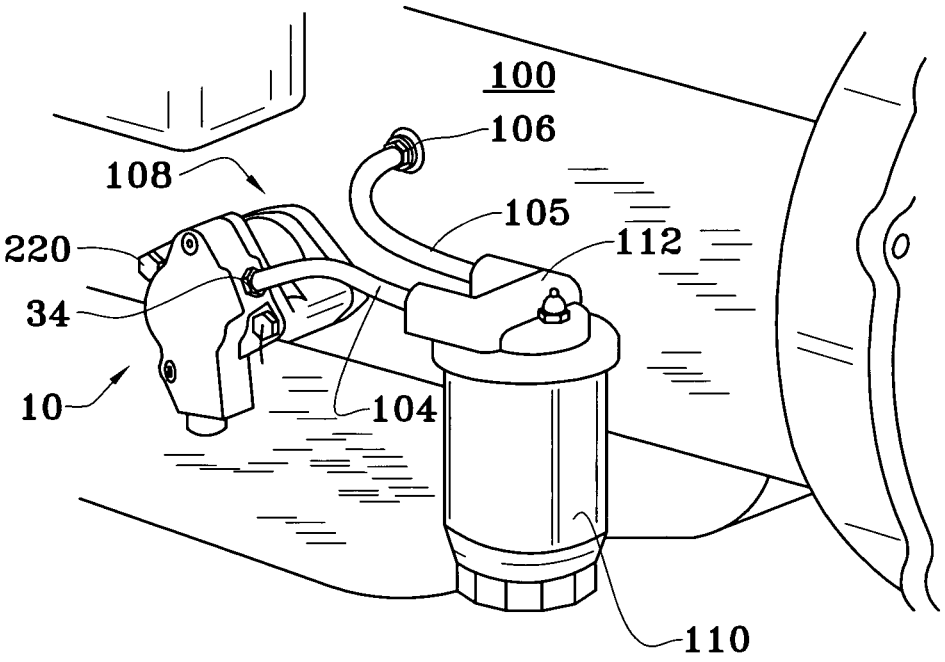
FIG. 5 is a perspective view of the pump modification adaptor installed on an engine connecting to a full-flow filter.

For the purposes of this disclosure, a gross flow from the pump 108 is defined as the unregulated, theoretical output volume from the pump under a given set of conditions. A net flow is defined as the regulated volume of oil expelled by the pump 108 at design pressure into the engine, the engine having a plurality of moving parts, the net flow lubricating the moving parts. A surplus volume is the difference between the unregulated, theoretical output volume and the net flow volume, the surplus flow recirculating within the pump 108 and adaptor 10, as shown in FIG. 5. The term "engine design oil pressure" is here defined to mean the pressure maintained by the net flow to the engine as established by the manufacturer. The term "communicates with" is defined to mean fluid communication.

Under operating conditions such as, for example, but not limited to, when the engine speed is low, where the demand for flow necessary to maintain design pressure is equal to, or less than, the pump output volume, the plunger tip 72 sits in the regulator bore 62 at the plunger end 62P of the bore 62. At that position, the regulator plunger 68 blocks the regulator bore outlet port 21 and outlet channel 22, preventing communication of the distribution cavity 30 with the circulation cavity 20. The gross output of the pump 108 is communicated to the outlet port 34 of the adaptor 10 with no degree of regulation required because there is no surplus oil flow. As pressure rises in the distribution cavity 30 due to operating conditions where the gross oil flow exceeds the net flow requirements of the engine, the plunger 68 moves axially in response to the distribution cavity pressure against the resistance of the compression spring, moving sufficiently toward the retainer end 62R until the plunger begins to uncover the regulator bore outlet channel 22, putting the regulator bore inlet passage 36 and the outlet channel 22 in fluid communication. As the plunger 68 moves toward the regulator spring retainer end 62R, the inlet passage 36 comes into fluid communication with the circulation cavity 20 through regulator bore 62, the movement of the plunger 68 variably exposing the outlet channel 22, causing a regulated volume of oil to flow from the distribution cavity 30 to the circulation cavity 20. The magnitude of the opening to the outlet channel 22 where it intersects the regulator bore 62P varies with the axial movement of the plunger 68 in proportion with the volume of surplus oil flow, thus maintaining constant oil pressure. The surplus oil flow enters the circulation cavity 20 and recirculates within the adaptor 10, thereby regulating the pressure in the distribution cavity 30, reducing the flow from the distribution cavity 30 to the filter 110 to the net flow requirements of the engine at the design oil pressure. An equilibrium is reached when the force generated by oil pressure in the regulator bore segment 62P has displaced the plunger 68 toward the regulator bore end 62R sufficiently to expose the regulator bore outlet channel 22, thereby generating an equal and opposite counterforce on the plunger and establishing a path for a surplus volume of oil to flow from the distribution cavity 30 to the circulation cavity 20. Any further rise in the surplus volume of oil results in still further displacement of the plunger and an increased exposure of the cross-sectional area of channel 22. Conversely, less surplus flow volume results in a reduction in the flow of oil from the distribution cavity 30 to the circulation cavity 20. In this fashion, the regulator 60 maintains the engine design oil pressure by regulating the oil flow volume proportionate to the requirements of the engine.

FIG. 4 shows the oil pump 108 on the engine block 100 without the adaptor 10, the pump drawing oil from the reservoir 102. The original equipment pump 108 has a steel plate 40 on the exterior side 127 of the pump, and installation of the adaptor on the pump requires replacing the original steel plate of the pump with the adaptor as well as occluding the outlet port 133 of the pump with an occluding means 137. In FIG. 4, the filter 110 has been omitted, of course, because, in its original configuration and prior to the instant invention, the Hudson automobile was not provided with a full-flow type of engine lubricating oil filter.

FIG. 6 shows, in an exploded view, the adaptor installed on the oil pump 108. The pump has a housing 128, a pump inlet port 134, a pump outlet port 133, both shown in outline, and a rotor element assembly R comprising an inner trochoid element 131 fixed to the exterior end of a rotor shaft 210 and a surrounding, trochoid ring element 132. The adaptor 10 and the pump 108 have a plurality of fastener openings 12, and the engine block 100 has threaded fastener openings 12'. The adaptor 10 attaches to the pump 108 and engine by a plurality of fasteners 13, such as for example, but not limited to bolts, the fasteners inserting through the fastener openings 12 of the adaptor and further inserting through the fastener openings 12 of the pump 108 and further inserting fasteners 240 through the fastener openings 12' of the engine block 100, thereby attaching the adaptor to the pump and engine by tightening the fasteners.

The engine block 100 further has a plurality of openings, a pump socket 126, a block outlet port 122, a block inlet port 124, and, on some vintage motor vehicles, such as the exemplary Hudson automobile described and depicted herein, an oil sender unit port 106 into which is threaded an oil sender that is wired to an oil pressure indicator in the dashboard (not shown). A gasket 120 is placed between the pump housing 128 and the engine openings. The gasket 120 has fastener openings 12, a pump socket opening 126G and block outlet port opening 122G, but no block inlet port opening, effectively preventing oil flow into the engine block 100 directly without passing through the filter 110, further preventing unfiltered oil with suspended particulates entering the engine and causing excessive wear and tear. Occluding the engine block oil inlet port 124 with the gasket 120 is one means of preventing oil flowing untreated from the pump 108 with the adaptor 10 and is a non-limiting example. Other means of blocking the pump outlet port to direct the oil to the adaptor and exit through the adaptor to the filter are possible within the inventive concept, the means adapted for pump configurations used on other engines. Because installation of the adaptor 10 precludes oil from thereafter flowing back into the engine block 100 from the oil pump/adaptor combination through the engine block oil inlet port 124, an alternate engine block oil inlet port must be provided for that purpose. In the case of the Hudson and certain other vintage motor vehicles having engines blocks with an oil sender unit port 106, the oil sender unit port can serves as the required alternate engine block oil inlet port. In other vintage motor vehicles, such as certain 1930s through 1950s era Chrysler motor models, there is no oil sender unit port on the engine block, and it is necessary to create an alternate engine block oil inlet port by drilling a hole in the block and mounting within the hole a suitable fitting for attachment of an oil conduction tube 105. Thus, the term "alternate engine block oil inlet port," as used herein and denoted by the numeral 106, shall refer to either an oil sender unit port, if the engine block 100 has such a port, after removal therefrom of the oil sender unit or, if no oil sender port exists on the block, an oil inlet port on the engine block specially created as part of the installation of the adaptor on the oil pump 108. In either case, the alternate engine block oil inlet port 106 communicates with the oil passages and galleries within the engine block.

Without the adaptor 10 in place, as is well-known in the prior art, oil enters the pump 108 through the pump inlet port 134. The oil is then conveyed by the rotation of the pump rotor assembly R through the pump and out the pump outlet port 133. However, with the adaptor 10 in place, oil enters the pump 108 through the pump inlet port 134 and then is conveyed by rotation of the pump rotor assembly R through the pump. The pump outlet port is now blocked by the occluding means 137, thus causing the oil to enter the adaptor distribution cavity 30. Oil pressure will rise in the adaptor distribution cavity 30 until it reaches that which is sufficient to initiate action of the regulator 60, as described hereinabove. So long as the oil pressure is at or below the engine design oil pressure, oil flows from the outlet port 34 on the adaptor 10, with no oil recirculating within the oil pump/adaptor combination 10, 108.

FIG. 5 shows the adaptor 10 installed on the pump 108 and in fluid communication with a filter inside a disposable, oil filter cartridge 110. The filter cartridge 110 is attached to a filter assembly 112. A first tube 104 connects the adaptor outlet port 34 to the filter assembly 112, a second tube 105 connects the filter assembly to the alternate engine block inlet port 106. The net flow exits the adaptor 10 through the first tube 104, is filtered by the filter 110 in the filter assembly 112, exits the filter 110 through the second tube 105, and only filtered oil enters the engine block 100.

Figure 7:
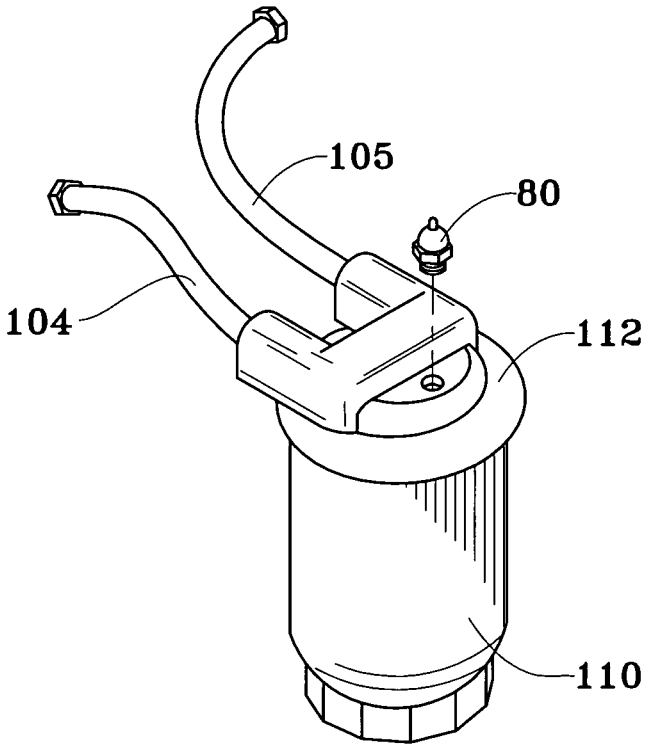
FIG. 7 is an exploded view of a relief valve on a filter for the full-flow filter.

FIG. 7 shows a pressure relief valve 80 on the filter assembly. It is understood by those of ordinary skill that the pressure relief valve, integral to the filter assembly 112 as illustrated, is a non-limiting example and that other configurations are possible depending upon the configuration of the filter assembly.

The adaptor as described and illustrated herein is fitted to an oil pump 108 in a bypass filter system or a no-filter system, such as found on a vintage automobile (e.g., a Hudson brand motor car), but the adaptor is selectively customizable to other brands of automobiles having a bypass filter system or a no-filter system, such as, for example, but not limited to, Packard, Studebaker, Nash and Willys, as well as older models produced by Ford, Pontiac and others.

Referring to FIG. 1, to modify the adaptor 10 to other automobile models, such as those listed hereinabove, a user modifies or disables the original oil pressure regulating device as described hereinabove and installs the adaptor having the mating surface 50. The adaptor provides the circulation cavity 30, said cavity having the same size and shape opening as that on the outlet cavity 230 of the oil pump and in the same relative position to the inlet cavity 220 of the oil pump, the opening of the circulation cavity 20 of the mating plate mirroring the pump inlet cavity 220. Further, the adaptor 10 provides the distribution cavity 30, said cavity having the same size and shape opening on the mating plate 50 as that of the outlet cavity 230 of the oil pump in a same relative position to the inlet cavity 22 of the oil pump, the distribution cavity of the mating plate mirroring the pump outlet cavity. The adaptor 10 further provides an outlet port 34 on the adaptor that is directed away from the pump, the outlet port 34 having the port channel 32 in fluid communication with the distribution cavity 30.

As shown in FIG. 6, to install the adaptor 10, the user removes the end plate 40 from the pump 108. The user blocks the pump outlet port 133 with the occluding means 137. The user aligns the circulation cavity 20 of the adaptor 10 to its mirror image formed by the inlet cavity 230 of the pump 108 and aligns the distribution cavity 30 of the adaptor with its mirror image formed by the pump outlet cavity 230; see FIG. 8. The user inserts the fasteners 13 and the fasteners 240 through the attachment holes 12, 12' and tightens them, thereby connecting the adaptor to the pump 108 and further connecting the pump to the engine block 100.

Figure 11:
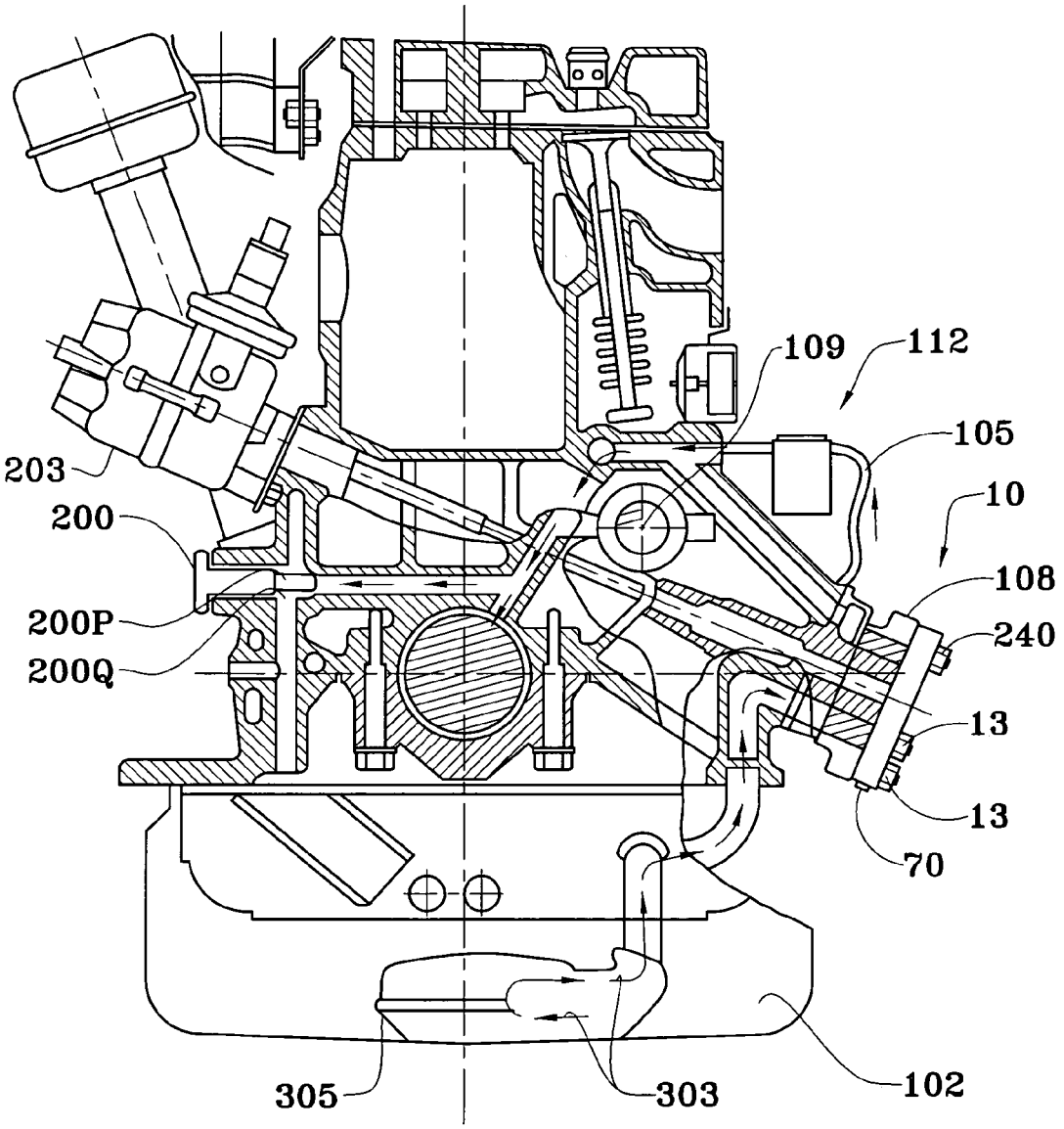
FIG. 11 is a lateral, cross-sectional view thereof along line 11-11 of FIG. 9, showing the modified flow path achieved by substitution of the adaptor in place of an end plate on the oil pump and routing oil from the oil outlet port of the adaptor through an oil filter and into an engine oil inlet port on the engine block.

As shown in FIG. 5, the user attaches the first tube 104 to the outlet port 34 on the adaptor 10, connecting the filter assembly 112 to the adaptor and further attaches the second tube 105 to the engine inlet port 106, thereby connecting the filter assembly 112 to the engine block 100. The user installs the filter 110 into the filter assembly 112. With the adaptor 10 installed as described hereinabove, the full-flow system is engaged. Referring to FIG. 11, the oil pump 108 pumps oil from the oil reservoir 102, entering the inlet port 134 of the pump and further entering the distribution cavity 30. From the distribution cavity 30 the oil is propelled by the rotation of the rotor assembly R out the adaptor outlet port 34 and circulates through the filter assembly 112 and through the engine block 100 so long as the oil pressure is less than or equal to the engine design oil pressure, and, at the same time, the plunger tip 72 of the regulator plunger 68 remains in or near the blind, bore segment 62P of the regulator bore 62; whereas, when the oil pressure reaches the engine design oil pressure, the plunger 68 is displaced toward the retainer end 62R of the regulator bore 62, and the surplus oil instead flows from the distribution cavity 30 through the regulator bore inlet channel 36 into the circulation cavity 20 and recirculates from there within the pump itself. Accordingly, surplus oil enters the circulation cavity 20 and recirculates within the pump 108/adaptor 10 combination, thereby regulating the pressure in the distribution cavity 30 and regulating the flow from the distribution cavity 30 to the filter 110, the flow of oil being thereby reduced to the net flow requirements of the engine at the engine design oil pressure. Only the net flow requirement of oil flows from the distribution cavity 30 through the outlet port 34 and to the filter 110, removing suspended particulates, the filtered oil flowing from the filter into the engine block 100.

Figure 3:
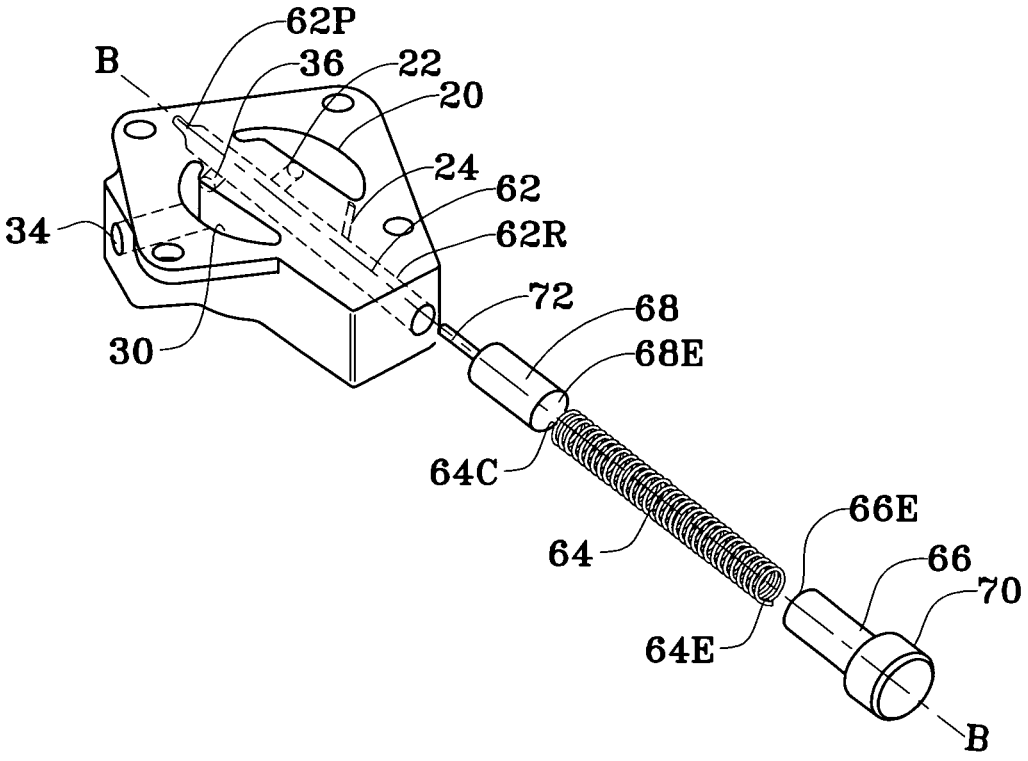
FIG. 3 is a diagrammatic perspective view of the pump modification adaptor with a regulator shown in an exploded view.
Figure 15:
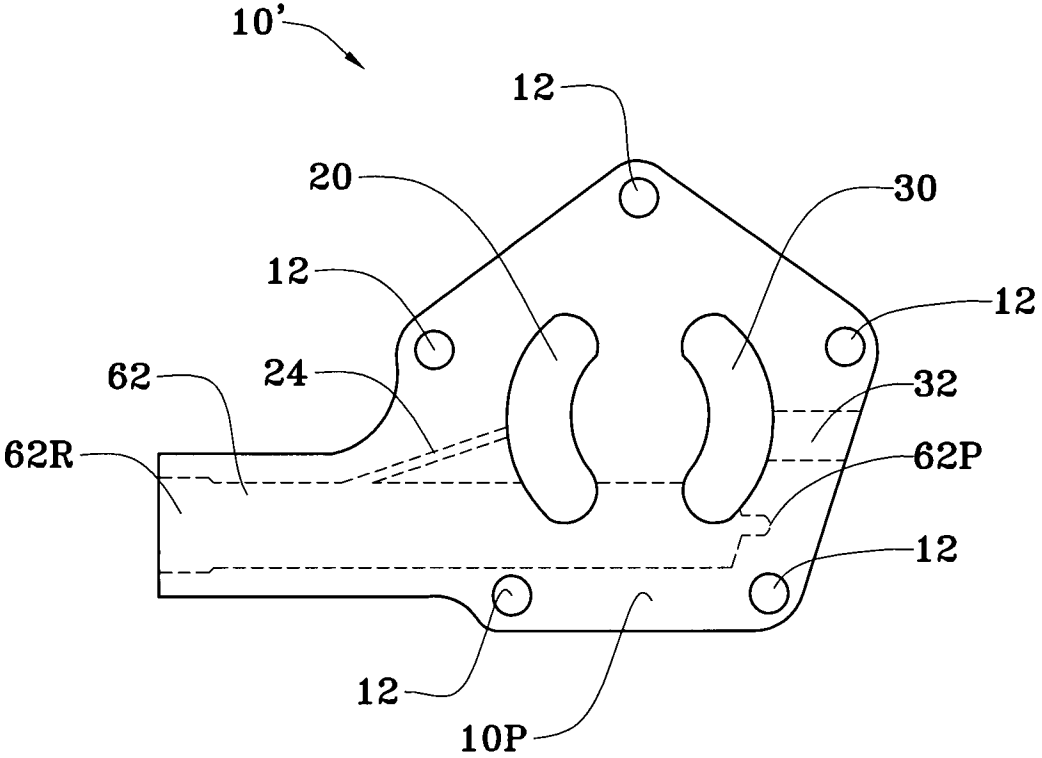
FIG. 15 is an elevational view of an interior side of an adaptor according to an alternative embodiment of the invention, shaped and dimensioned for attachment to a 1930s to 1950s era, Chrysler Corporation flathead, 6 or 8 cylinder, automobile engine oil pump, wherein the distribution and circulation cavities are each disposed on the same side of the regulator bore; the regulator bore and the outlet port are shown in phantom outline; and the regulator plunger, compression spring, spring guide and spring retainer are omitted from the figure for the sake of clarity.

Although the distribution and the circulation cavities 30, 20 are depicted in FIGS. 1 and 3 as being disposed on opposite sides of the regulator bore 62, the invention is not limited to that configuration. For instance, FIG. 15 depicts an alternative embodiment of the adaptor 10' for use with a 1930s to 1950s era Chrysler flathead, 6- or 8-cylinder automobile engine, wherein the distribution cavity 30 and the circulation cavity 20 are each disposed on the same side of the regulator bore 62. This alternative embodiment of an adaptor 10' has no outlet channel 22 or regulator bore inlet passage 36 because its bore 62 communicates directly with its circulation cavity 20 and with its distribution cavity 30, but a relief channel 24 is still required.

Figure 16:
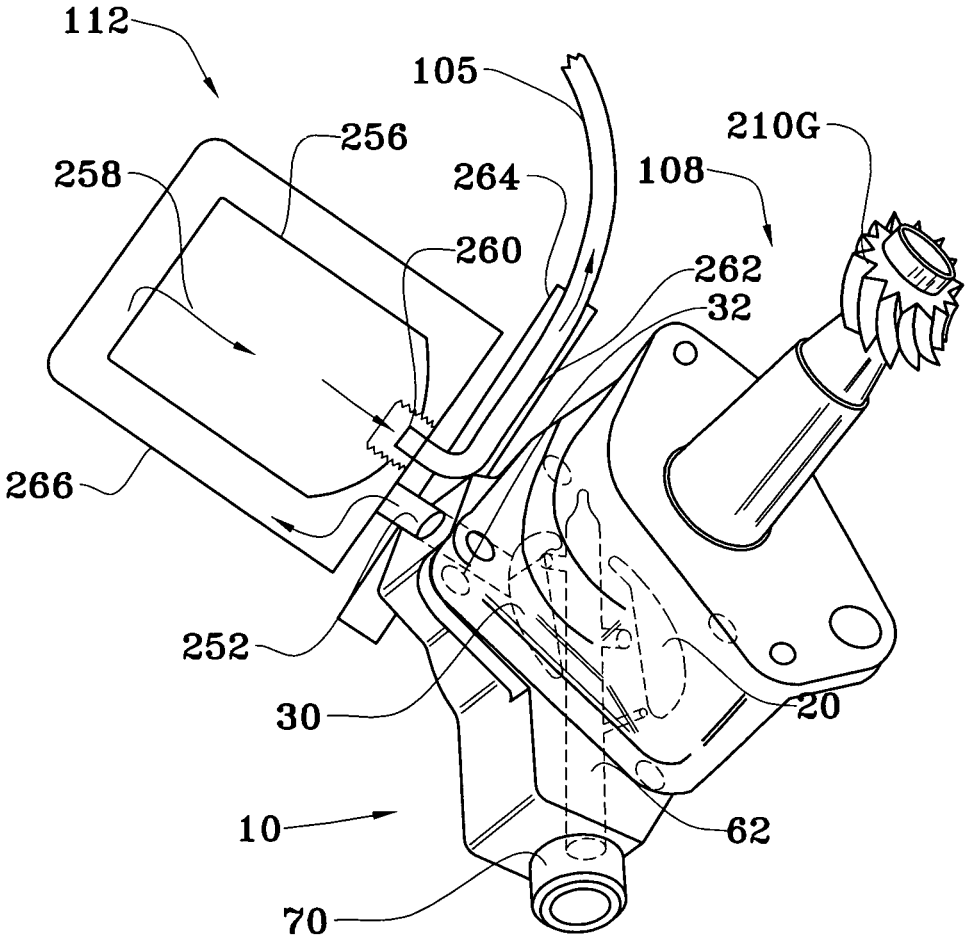
FIG. 16 is a perspective view of the adaptor of FIG. 1 attached to an oil pump, and with an oil filter assembly mounted on the adaptor such that oil discharged through the oil outlet port of the adaptor passes through the filter assembly prior to flowing back to the engine block.

Instead of mounting the filter assembly 112 to the engine separate and apart from the adaptor/pump combination 10/108, the filter assembly 112 can be joined to the adaptor 10 adjacent to the oil outlet port 34 of the adaptor with the oil inlet port 252 of the filter assembly aligned, and in communication with the oil outlet port of the adaptor; FIG. 16. Oil discharged through the adaptor oil outlet port 34 (arrow 204) is filtered as it passes through the filter element 256 (arrow 258) within an outer casing 266 of a screw-on filter cartridge 110 and on through an externally-threaded, hollow nipple 260 of the filter assembly 112 onto which has been threaded a disposable oil filter cartridge 110; thence flows (arrow 270) through a passage 262 in a base portion of the filter assembly and through a first end of an attached tube 105 attached to an outlet port 264 of the filter assembly. An opposite, second end (not shown) of the tube 105 is attached to an oil inlet port of the engine block 100. The filter assembly 112 and the adaptor 10 initially can be made as two separate components and afterwards joined together, e.g., by welding or threaded fasteners (not shown), in which case a gasket (not shown) should be placed between them to prevent oil leaks.

Figure 17:
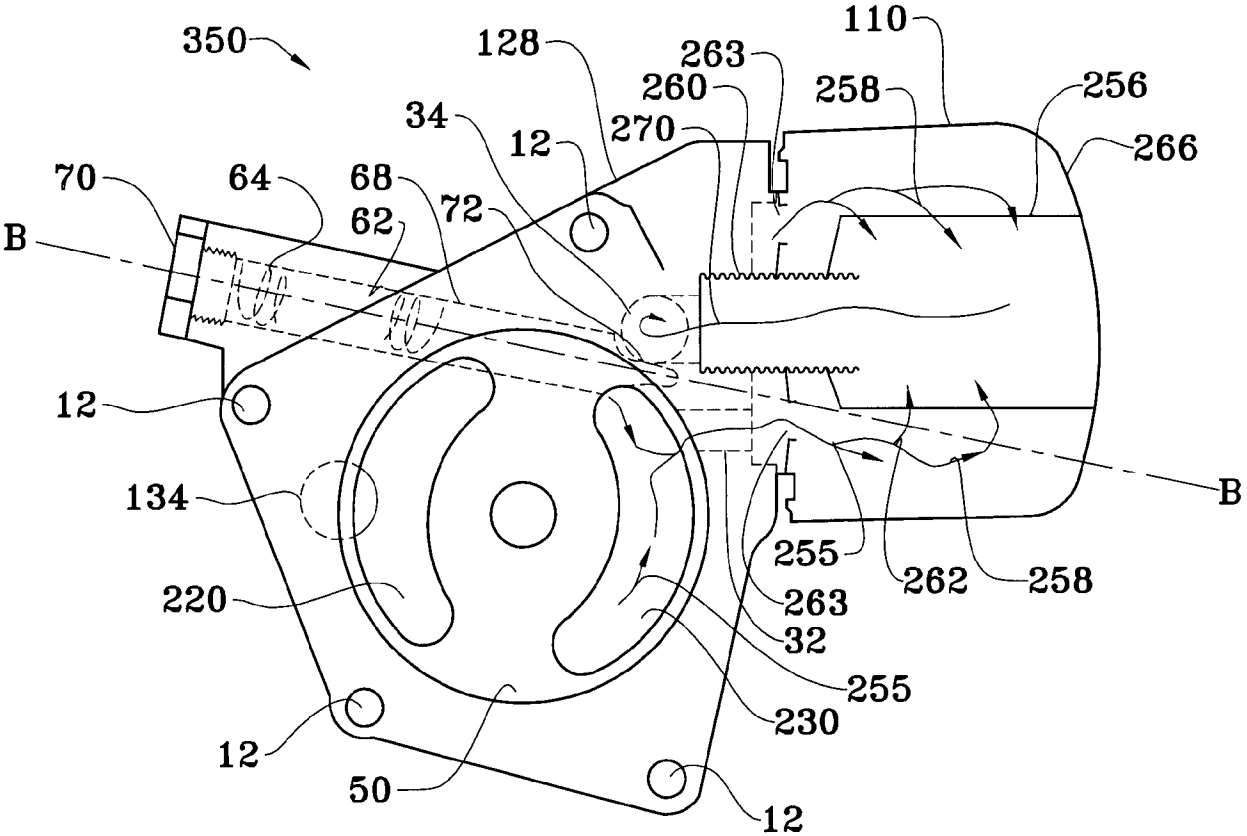
FIG. 17 is a cross-sectional view of an integral adaptor/oil pump/oil filter assembly combination, taken along the axis B-B of the regulator bore of the adaptor and perpendicular to the oil pump shaft axis A-A.

Alternatively, as depicted in FIG. 17, the filter assembly and the regulator portions of the adaptor can be cast in metal together with an oil pump as a combination of a single, integral pump/filter assembly unit 350, with said regulator portion situated, for instance, intermediate the rotor means R and the end plate 40 of the pump portion of the combination. The pump portion 108 is substantially identical to, and includes the same components, as the pump 108 described hereinabove, except that the pump housing 128 is preferably lengthened along the A-A axis insofar as necessary to accommodate the inclusion of the regulator portion and adapted for joining the filter assembly portion 112 thereto. As in the case of the above-described adaptor 10, the regulator portion includes a regulator bore 62 that extends from an open end thereof to an opposite, blind, plunger end inside the housing; a regulator bore inlet passage that extends from the pump oil outlet cavity 230 to the plunger end of the regulator bore 62; an outlet channel 22 disposed intermediate the regulator bore inlet passage and the open end of the regulator bore; a relief channel 24 disposed intermediate the regulator bore inlet passage and the open end of the regulator bore; a regulator plunger 68 mounted for sliding, reciprocal motion within the plunger bore 62; spring retention means attached to the open end of the regulator bore for retaining a compression spring within the bore; and a compression spring 64 interposed and compressed between the spring retention means and the regulator plunger 68. The combination 350 further includes a removable end plate 40 that is attachable to the exterior wall 127 of the housing 128 to close off the hollow, interior space S of the housing. The oil filter assembly portion 112 is joined to the combination 350 and includes an externally-threaded, hollow nipple 260 for screw-on attachment of a disposable oil filter cartridge 110, which nipple communicates with the pump outlet port 133; and an annular opening 263 that surrounds said nipple and communicates with the pump outlet cavity 230.

In this integrated oil pump/filter assembly combination 350, with a disposable oil filter cartridge 110 threaded onto the nipple 260 and with the engine operating, so long as the oil pressure is less than or at engine design oil pressure, oil pumped from the pump oil outlet cavity 230 (arrow 255), enters the disposable, filter cartridge through the annular opening 263, passes through the filter element 256 (arrows 258) within the cartridge, exits the filter cartridge through a the hollow nipple 260, thence exits the combination through the oil outlet port 34 of the oil pump portion of the combination. Accordingly, in the case of this integral combination 350, the outlet port 34 of the oil pump must be left not occluded and there is no need in this case for an alternate engine block oil inlet port 106 because the engine block oil inlet port 124 remains available to receive lubricating oil from the integral filter assembly/oil pump combination. Whenever oil pressure rises above the engine design oil pressure, the surplus oil recirculates within the integral oil pump/oil filter assembly combination.

Example embodiments are described herein with reference to schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. It is further understood that, although ordinal terms, such as, "first," "second." "third," are used herein to describe various elements, these elements should not be limited by these terms. These terms are only used to distinguish one element from another element. Thus, the regions illustrated in the figures are schematic in nature and their shapes are not intended to illustrate the precise shape of a region and are not intended to limit the scope of the present claims.

In conclusion, herein is presented an oil pump modification adaptor for an automobile. The disclosure is illustrated by example in the drawing figures, and throughout the written description. It should be understood that numerous variations and equivalents are possible, while adhering to the inventive concept. Such variations are contemplated as being a part of the present disclosures.

I claim:

1. An adaptor that modifies an oil pump in a reciprocating, internal combustion engine having either no oil filtration system or a bypass oil filtration system and converts said system to a full-flow, oil filtration system, said engine including an engine block that has an oil outlet port in communication with an oil reservoir, an oil inlet port and alternate oil inlet port in communication with oil galleries and passages of the engine block, and oil pump drive means, said oil pump including a pump housing that extends along an axis A-A from an interior wall to an opposite, exterior wall thereof and defines a hollow, interior space between said walls, the exterior wall having an opening in communication with the hollow, interior space and the interior wall defining a pump oil inlet cavity and a pump oil outlet cavity that are spaced apart in side by side relation, and said interior wall has a shaft aperture;

pump oil inlet and outlet ports in communication with the pump oil inlet and oil outlet cavities, respectively, and in communication with the hollow, interior space of the housing;

means for mounting the interior wall of the housing to the engine block such that the engine block oil outlet port communicates with the pump inlet port;

a rotor shaft mounted for rotation within the interior of the housing about said shaft axis A-A, said shaft extending along said axis from an exterior end thereof within the housing, through the housing, and protruding through the shaft aperture to an interior end thereof;

a rotor element assembly in rotary, driven engagement with the exterior end of the rotor shaft for pumping oil from within the interior of the housing out the pump outlet port;

means attached to the interior end of the rotor shaft for coupling the rotor shaft to the oil pump drive means in rotary, driven engagement; and a removable end plate for covering the exterior wall of said housing;

said adaptor comprising:

occluding means attachable to the pump for occluding the pump outlet port; and a plate that includes a flat, interior side and an opposite, exterior side, wherein said interior side is shaped and dimensioned to cover and close off the opening of the exterior wall of the housing when the adaptor is attached to said exterior wall;

an oil distribution cavity and an oil circulation cavity extend part way from said interior side toward said exterior side within said plate and are disposed in spaced apart, side by side relation such that, when said interior side of said plate is attached to the exterior side of the housing, said oil distribution and circulation cavities matingly align and communicate with the oil outlet and inlet cavities of the pump, respectively;

said plate has an outlet port that communicates with the oil distribution cavity through a port channel;

a regulator bore extends through the plate from an open end to an opposite, blind, plunger end;

at the plunger end of the bore, a regulator bore inlet passage extends from the oil distribution cavity to the regulator bore;

an outlet channel, disposed intermediate the regulator bore inlet passage and the open end of the regulator bore, extends from a regulator bore outlet port to the circulation cavity;

a relief channel, disposed intermediate the outlet channel and the open end of the regulator bore, extends from the regulator bore to the circulation cavity;

a regulator plunger is disposed for sliding, reciprocating motion within the plunger bore;

spring retention means attached to the open end of the regulator bore for retaining the spring within said bore; and a compression spring is interposed and compressed between the spring retention means and the regulator plunger, said spring having dimensions and spring resistance such that, after the occluding means has been attached to the pump, the end plate has been removed from the pump, and the adaptor has been attached to the exterior wall of the housing with the oil distribution and circulation cavities of the adaptor matingly aligned with the oil outlet and inlet cavities of the pump, respectively, and with the engine operating, whenever the pressure of oil on the regulator bore is less than engine design oil pressure, the plunger remains at the plunger end of the bore and oil exits the pump through the outlet port of the adaptor; and, whenever the pressure of oil on the regulator plunger equals or exceeds the engine design oil pressure, the oil pressure at the plunger end of the bore forces the regulator plunger to slide towards the spring retention means, thereby compressing the spring and uncovering the regulator bore outlet channel, whereby surplus oil flows through the regulator bore inlet passage into the circulation cavity and thence recirculates within the pump/adaptor combination.

2. The adaptor of claim 1, wherein the spring retention means comprises a spring retainer cap inserted into said open end of the regulator bore and fixed thereto; and a spring guide disposed between said spring retainer cap and the spring.

3. The adaptor of claim 1, wherein the exterior wall of the pump includes a peripheral flange portion that surrounds the opening of said exterior wall, which flange portion has a plurality of apertures, at least two of which apertures extend through the interior wall of the pump, an external surface of the engine block has threaded apertures that matingly align with said apertures of said peripheral flange portion when the pump is mounted to the engine block, and the adaptor has a plurality of apertures that matingly align with said apertures of said peripheral flange when the oil distribution and circulation cavities of the adaptor are matingly aligned with the oil outlet and inlet cavities of the pump, respectively, whereby a plurality of bolts inserted through the apertures of the adaptor and through the apertures of the peripheral flange and threaded into said threaded apertures of the block simultaneously secure the adaptor to the pump and the pump to the block with the rotor shaft coupled in rotary, driven engagement to the oil pump drive means.

4. The adaptor of claim 1, wherein the distribution cavity and the circulation cavity are each crescent-shaped in lateral cross-section.

5. A method for converting an oil pump in a reciprocating, internal combustion engine having either no oil filtration system or a bypass oil filtration system to a full-flow, oil filtration system, said engine including an engine block that has an oil outlet port in communication with an oil reservoir, an oil inlet port in communication with oil galleries and passages of the engine block, a normally-closed, oil pressure regulating valve that receives oil from oil passages and galleries within the engine block and opens to permit flow of oil through said valve for discharge into an engine oil reservoir whenever the oil pressure is at or above engine design oil pressure, and oil pump drive means within the engine block;

said pump including a pump housing that extends along an axis A-A from an interior wall to an opposite, flat exterior wall thereof and defines a hollow interior space between said walls, the exterior wall having an opening in communication with the hollow interior space and the interior wall defining a pump oil inlet cavity and a pump oil outlet cavity that are spaced apart in side by side relation, and said interior wall having a shaft aperture;

pump oil inlet and outlet ports in communication with the pump oil inlet and oil outlet cavities, respectively, and in communication with the hollow interior space of the housing;

means for mounting the interior wall of the housing to the engine block such that the engine block oil outlet port aligns and communicates with the pump inlet port;

a rotor shaft mounted for rotation within the interior of the housing about said shaft axis A-A, said shaft extending along said axis from an exterior end thereof within the housing, through the housing, and protruding through the shaft aperture to an interior end thereof;

a rotor element assembly in rotary, driven engagement with the exterior end of the rotor shaft for pumping oil from within the interior of the housing out the pump outlet port;

means attached to the interior end of the rotor shaft for coupling the rotor shaft to the oil pump drive means in rotary, driven engagement; and a removable end plate for covering the exterior wall of said housing;

said method comprising:

inactivating said oil pressure regulating valve;

occluding the outlet port of the pump to prevent oil from exiting the pump through said port;

removing the end plate from the pump, thereby exposing the exterior wall of the housing;

attaching to said exterior wall of the housing a plate that includes a flat, interior side and an opposite exterior side, wherein said interior side is dimensioned to cover and close off the opening of the exterior wall of the housing when the adaptor is attached to the exterior wall of the housing;

an oil distribution cavity and an oil circulation cavity extend part way from said interior side toward said exterior side within said plate and are disposed in spaced apart, side by side relation such that, when said interior side of said plate is attached to the exterior wall of the housing, said oil distribution and circulation cavities matingly align and communicate with the oil outlet and inlet cavities of the pump, respectively;

said plate has an outlet port that communicates with the oil distribution cavity;

a regulator bore extends through the plate from an open end to an opposite, blind, plunger end thereof;

adjacent to the plunger end of the bore, a regulator bore inlet passage extends from the oil distribution cavity to the regulator bore;

an outlet channel, disposed intermediate the regulator bore inlet passage 36 and the open end of the regulator bore, communicates with, and extends from, a regulator bore outlet port to the circulation cavity;

a relief channel, disposed intermediate the outlet channel and the open end of the regulator bore, extends from the regulator bore to the circulation cavity;

a regulator plunger is mounted for sliding, reciprocating motion within the plunger bore;

spring retention means is attached to the open end of the regulator bore for retaining the spring within said bore; and a compression spring is interposed and compressed between the spring retention means and the regulator plunger, said spring having dimensions and spring resistance such that, after the occluding means has been attached to the pump, the end plate has been removed from the pump, and the adaptor has been attached to the exterior wall of the housing with the oil distribution and circulation cavities of the adaptor matingly aligned with the oil outlet and inlet cavities of the pump, respectively, and with the engine operating, whenever the pressure of oil on the regulator is less than the engine design oil pressure for said engine, the plunger remains at or near the plunger end of the bore and oil exits the pump through the outlet port of the adaptor, and whenever the pressure of oil on the regulator plunger is at or exceeds said engine design oil pressure, the oil pressure at the plunger end of the bore forces the regulator plunger to slide towards the spring retention means, thereby compressing the spring and uncovering the regulator bore outlet channel, whereby oil flows through the regulator bore inlet passage into the circulation cavity and thence recirculates within the pump/adaptor combination;

if the engine block has an oil sender unit port, removing the oil sender unit from said port to convert said port into an alternate engine block oil inlet port, or, if the engine block lacks an oil sender unit port, creating an alternate engine block oil inlet port that communicates with the oil passages and galleries within the engine block;

attaching a first end of a first oil conduit to the outlet port of the adaptor and an opposite, second end thereof to the inlet port of an oil filter assembly; and attaching a first end of a second oil conduit to the outlet port of said oil filter assembly and an opposite, second end thereof to said alternate engine block oil inlet port.

6. The method of claim 5, wherein the spring retention means comprises a spring retainer cap inserted into said open end of the regulator bore and fixed thereto; and a spring guide disposed between said spring retainer cap and the spring.

7. The method of claim 5, wherein the exterior wall of the pump includes a peripheral flange portion that surrounds the opening of said exterior wall, which flange portion has a plurality of apertures, at least two of which apertures extend through the interior wall of the pump, an external surface of the engine block has threaded apertures that matingly align with said apertures of said peripheral flange portion when the pump is that matingly align with said apertures of said peripheral flange portion when the pump is mounted to the engine block, and the adaptor has a plurality of apertures that matingly align with said apertures of said peripheral flange when the oil distribution and circulation cavities of the adaptor are matingly aligned with the oil outlet and inlet cavities of the pump, respectively, whereby a plurality of bolts inserted through the apertures of the adaptor and through the apertures of the peripheral flange and threaded into said threaded apertures of the block simultaneously secure the adaptor to the pump and the pump to the block with the rotor shaft coupled in rotary, driven engagement to the oil pump drive means.

8. The combination of an oil pump and an adaptor that modifies said oil pump in a reciprocating, internal combustion engine having either no oil filtration system or a bypass oil filtration system, which combination converts said oil filtration system to a full-flow, oil filtration system, said engine including an engine block that has an oil outlet port in communication with an oil reservoir, an oil inlet port and an alternate oil inlet port in communication with oil galleries and passages of the engine block, and oil pump drive means, said combination including an oil pump, said oil pump comprising:

a pump housing that extends along a shaft axis A-A from an interior wall to an opposite, flat, exterior wall thereof and defines a hollow interior space between said walls, the exterior wall having an opening in communication with the hollow interior space and the interior wall defining a pump oil inlet cavity and a pump oil outlet cavity that are spaced apart in side by side relation and said interior wall has a shaft aperture;

pump oil inlet and outlet ports in communication with the pump oil inlet and oil outlet cavities, respectively, and in communication with the hollow interior space of the housing;

means for mounting the interior end of the housing to the engine block such that the engine block oil outlet port communicates with the pump inlet port;

a rotor shaft mounted for rotation within the interior of the housing about said shaft axis A-A, said shaft extending along said axis from an exterior end thereof a rotor element assembly in rotary, driven engagement with the exterior end of the rotor shaft for pumping oil from within the interior of the housing out the pump outlet port; and means attached to the interior end of the rotor shaft for coupling the rotor shaft to the oil pump drive means in rotary, driven engagement, and said adaptor comprising:

occluding means attachable to the pump for occluding the pump outlet port; and a plate that includes a flat, interior side and an opposite exterior side, wherein said interior side is dimensioned to cover and close off the opening of the exterior wall of the housing when the adaptor is attached to the exterior wall of the housing;

an oil distribution cavity and an oil circulation cavity extend part way from said interior side toward said exterior side within said plate and are disposed in spaced apart, side by side relation such that, when said interior side of said plate is attached to the exterior side of the housing, said oil distribution and circulation cavities align and communicate with the oil inlet and outlet cavities of the pump, respectively;

said plate has an outlet port that communicates with the oil distribution cavity;

a regulator bore extends through the plate from an open end to an opposite, blind, plunger end;

adjacent to the plunger end of the bore, a regulator bore inlet passage extends from the oil distribution cavity to the regulator bore;

an outlet channel, disposed intermediate the regulator bore inlet passage and the open end of the regulator bore, extends from, a regulator bore outlet port to the circulation cavity;

a relief channel, disposed intermediate the outlet channel and the open end of the regulator bore, communicates with, and extends from, the regulator bore to the circulation cavity;

a regulator plunger is mounted for sliding, reciprocating motion within the plunger bore;

spring retention means attached to the open end of the regulator bore for retaining the spring within said bore; and a compression spring is interposed and compressed between the spring retention means and the regulator plunger, said spring having dimensions and spring resistance such that, after the occluding means has been attached to the pump, the end plate has been removed from the pump, and the adaptor has been attached to the exterior wall of the housing with the oil distribution and circulation cavities of the adaptor matingly aligned with the oil outlet and inlet cavities of the pump, respectively, the inlet and outlet sides of a filter assembly being in fluid communication with the outlet port of the adaptor and the alternate engine inlet port, respectively, and with the engine operating, whenever the pressure of oil on the regulator is less than engine design oil pressure, the plunger remains at or near the plunger end of the bore and oil exits the adaptor through the outlet port of the adaptor, and whenever the pressure of oil on the regulator plunger equals or exceeds the engine design oil pressure, the oil pressure at the plunger end of the bore forces the regulator plunger to slide towards the spring retention means, thereby compressing the spring and uncovering the regulator bore outlet port, whereby oil flows through the regulator bore outlet channel into the circulation cavity and thence recirculates within the pump/adaptor combination.

9. The combination of claim 8, wherein the spring retention means comprises a spring retainer cap inserted into said open end of the regulator bore and fixed thereto; and a spring guide disposed between said spring retainer cap and the spring.

10. The combination of claim 8, wherein the exterior wall of the pump includes a peripheral flange portion that surrounds the opening of said exterior wall, which flange portion has a plurality of apertures, at least two of which apertures extend through the interior wall of the pump, an external surface of the engine block has threaded apertures that matingly align with said apertures of said peripheral flange portion when the pump is mounted to the engine block, and the adaptor has a plurality of apertures that matingly align with said apertures of said peripheral flange when the oil distribution and circulation cavities of the adaptor are matingly aligned with the oil outlet and inlet cavities of the pump, respectively, whereby a plurality of bolts inserted through said apertures of said peripheral flange portion and threaded into said threaded apertures of the block simultaneously secure the adaptor to the pump and the pump to the block with the rotor shaft coupled in rotary, driven engagement to the oil pump drive means.

11. The combination of claim 8, wherein the distribution cavity and the circulation cavity are each crescent-shaped in lateral cross-section.

12. The combination of claim 8, further comprising an oil filter assembly joined to the adaptor adjacent to the oil outlet port of the adaptor, said assembly including an externally-threaded, hollow nipple for screw-on attachment of a disposable oil filter cartridge;

an oil inlet port in communication with said nipple and in communication with the oil outlet port of the adaptor; and an oil outlet port.

13. The combination of claim 12, wherein the distribution cavity and the circulation cavity are each crescent-shaped in lateral cross-section.

14. An oil pump/oil filtration assembly combination for use as a substitute for an original equipment oil pump in a reciprocating, internal combustion engine having either no oil filtration system or a bypass oil filtration system, which combination converts said system to a full-flow, oil filtration system, said engine including an engine block that has an oil outlet port in communication with an oil reservoir, an oil inlet port in communication with oil galleries and passages of the engine block, and oil pump drive means;

said combination including an oil pump portion, said oil pump portion comprising:

a pump housing that extends along a shaft axis A-A from an interior wall to an opposite, flat, exterior wall thereof and defines a hollow interior space between said walls, the exterior wall having an opening in communication with the hollow interior space and the interior wall defining a pump oil inlet cavity and a pump oil outlet cavity that are spaced apart in side by side relation on opposite sides of the shaft axis A-A and said interior wall has a shaft aperture;

pump oil inlet and outlet ports in communication with the pump oil inlet and oil outlet cavities, respectively, and in communication with the hollow interior space of the housing;

means for mounting the interior end of the housing to the engine block such that the engine block oil outlet port communicates with the pump inlet port;

a rotor shaft mounted for rotation within the interior of the housing about said shaft axis A-A, said shaft extending along said axis from an exterior end thereof within the housing through the housing and protruding through the shaft aperture to an interior end thereof;

a rotor element assembly in rotary, driven engagement with the exterior end of the rotor shaft for pumping oil from within the interior of the housing out the pump outlet port;

means attached to the interior end of the rotor shaft for coupling the rotor shaft to the oil pump drive means in rotary, driven engagement;

a regulator bore that extends part way through the housing from an open end thereof to an opposite, blind, plunger end;

a regulator bore inlet passage that extends from the pump oil outlet cavity to the plunger end of the regulator bore;

an outlet channel, disposed intermediate the regulator bore inlet passage 36 and the open end of the regulator bore, extends from a regulator bore outlet port to the circulation cavity;

a relief channel, disposed intermediate the outlet channel and the open end of the regulator bore, extending from the regulator bore to the circulation cavity;

a regulator plunger mounted for sliding, reciprocal motion within the plunger bore;

spring retention means attached to the open end of the regulator bore for retaining the spring within said bore;

a compression spring interposed and compressed between the spring retention means and the regulator plunger; and an oil filter assembly portion joined to said combination, said assembly including an externally-threaded, hollow nipple for screw-on attachment of a disposable oil filter cartridge, said nipple communicating with the pump oil outlet port;

an annular opening that surrounds said nipple and communicates with the pump outlet cavity; and an end plate attachable to said exterior wall of the housing; wherein, said outlet channel extends from the regulator bore to the pump inlet cavity; and said spring has dimensions and spring resistance such that, with the combination mounted to the engine block with the inlet and outlet cavities of the pump portion matingly aligned with the outlet and inlet ports of the block, during engine operation and with a disposable oil filter cartridge threaded onto said nipple, whenever the pressure of oil on the regulator is less than the engine design oil pressure, the plunger remains at or near the plunger end of the bore and oil exits the pump oil outlet cavity, flows through the annular opening of the filter assembly into the cartridge, through a filter element within the cartridge, from whence the filtered oil flows through the nipple, out the outlet port of the pump and into the engine block oil inlet port; and, whenever the pressure of oil on the regulator plunger equals or exceeds the engine design oil pressure, the oil pressure at the plunger end of the bore forces the regulator plunger to slide towards the spring retention means, thereby compressing the spring and uncovering the regulator bore outlet channel, whereby oil flows through the regulator bore outlet port and outlet channel into the pump oil inlet cavity and thence recirculates within the oil pump portion.

15. The combination of claim 14, wherein the combination is formed as a single, integral unit.

16. The combination of claim 15, wherein the spring retention means comprises a spring retainer cap inserted into said open end of the regulator bore and fixed thereto; and a spring guide disposed between said spring retainer cap and the spring.

17. The combination of claim 14, wherein the pump oil inlet cavity and the pump oil outlet cavity are each crescent-shaped in lateral cross-section.

18. An adaptor that modifies an oil pump in a reciprocating, internal combustion engine having either no oil filtration system or a bypass oil filtration system and converts said system to a full-flow, oil filtration system, said engine including an engine block that has an oil outlet port in communication with an oil reservoir, an oil inlet port and alternate oil inlet port in communication with oil galleries and passages of the engine block, and oil pump drive means, said oil pump including a pump housing that extends along an axis A-A from an interior wall to an opposite, exterior wall thereof and defines a hollow, interior space between said walls, the exterior wall having an opening in communication with the hollow, interior space and the interior wall defining a pump oil inlet cavity and a pump oil outlet cavity that are spaced apart in side by side relation, and said interior wall has a shaft aperture;

pump oil inlet and outlet ports in communication with the pump oil inlet and oil outlet cavities, respectively, and in communication with the hollow, interior space of the housing;

means for mounting the interior wall of the housing to the engine block such that the engine block oil outlet port communicates with the pump inlet port;

a rotor shaft mounted for rotation within the interior of the housing about said shaft axis A-A, said shaft extending along said axis from an exterior end thereof within the housing, through the housing, and protruding through the shaft aperture to an interior end thereof;

a rotor element assembly in rotary, driven engagement with the exterior end of the rotor shaft for pumping oil from within the interior of the housing out the pump outlet port;

means attached to the interior end of the rotor shaft for coupling the rotor shaft to the oil pump drive means in rotary, driven engagement; and a removable end plate for covering the exterior wall of said housing;

said adaptor comprising:

occluding means attachable to the pump for occluding the pump outlet port; and a plate that includes a flat, interior side and an opposite, exterior side, wherein said interior side is shaped and dimensioned to cover and close off the opening of the exterior wall of the housing when the adaptor is attached to said exterior wall;

an oil distribution cavity and an oil circulation cavity extend part way from said interior side toward said exterior side within said plate and are disposed in spaced apart, side by side relation such that, when said interior side of said plate is attached to the exterior side of the housing, said oil distribution and circulation cavities matingly align and communicate with the oil outlet and inlet cavities of the pump, respectively;

said plate has an outlet port that communicates with the oil distribution cavity through a port channel;

a regulator bore extends through the plate from an open end to an opposite, blind, plunger end and intersects and communicates with the oil distribution cavity and the oil circulation cavity such that the intersection of the bore with the oil distribution cavity is closer to the plunger end of the bore than the intersection of the bore with the oil circulation cavity;

a relief channel extends from the regulator bore to the circulation cavity;

a regulator plunger is disposed for sliding, reciprocating motion within the plunger bore;

spring retention means attached to the open end of the regulator bore for retaining the spring within said bore; and a compression spring is interposed and compressed between the spring retention means and the regulator plunger, said spring having dimensions and spring resistance such that, after the occluding means has been attached to the pump, the end plate has been removed from the pump, and the adaptor has been attached to the exterior wall of the housing with the oil distribution and circulation cavities of the adaptor matingly aligned with the oil outlet and inlet cavities of the pump, respectively, and with the engine operating, whenever the pressure of oil on the regulator bore is less than engine design oil pressure, the plunger remains at the plunger end of the bore occluding the intersection of the bore with oil circulation cavity and oil exits the pump through the outlet port of the adaptor; and, whenever the pressure of oil on the regulator plunger equals or exceeds the engine design oil pressure, the oil pressure at the plunger end of the bore forces the regulator plunger to slide towards the spring retention means, thereby compressing the spring and uncovering the intersection of the bore with the oil circulation cavity, whereby surplus oil flows into the circulation cavity and thence recirculates within the pump/adaptor combination.

* * * * *